US008206024B2

(12) United States Patent
Wenzel et al.

(10) Patent No.: US 8,206,024 B2
(45) **Date of Patent: *Jun. 26, 2012**

(54) ULTRASONIC TREATMENT CHAMBER FOR PARTICLE DISPERSION INTO FORMULATIONS

(75) Inventors: Scott W. Wenzel, Neenah, WI (US); John Glen Ahles, Neenah, WI (US); Thomas David Ehlert, Neenah, WI (US); Robert Allen Janssen, Alpharetta, GA (US); David William Koenig, Menasha, WI (US); Paul Warren Rasmussen, Neenah, WI (US); Steve Roffers, Neenah, WI (US); Shiming Zhuang, Menasha, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 681 days.

This patent is subject to a terminal disclaimer.

(21) Appl. No.: 11/966,418

(22) Filed: Dec. 28, 2007

(65) Prior Publication Data

US 2009/0168591 A1 Jul. 2, 2009

(51) Int. Cl.
*B01F 11/02* (2006.01)

(52) U.S. Cl. ..... 366/118

(58) Field of Classification Search ..... 366/113, 366/118, 127, 136, 137, 181.8
See application file for complete search history.

(56) References Cited

U.S. PATENT DOCUMENTS 2,115,056 A * 4/1938 Wynn ..... 366/118
2,307,206 A 1/1943 Fischer
2,584,053 A 1/1952 Seavey et al.
2,620,894 A 12/1952 Peterson et al.
2,661,192 A * 12/1953 Horsley et al. ..... 366/118
2,946,981 A 7/1960 O'Neill
3,066,232 A 11/1962 Branson
3,160,138 A 12/1964 Platzman
3,202,281 A 8/1965 Weston
3,239,998 A 3/1966 Carter et al.
(Continued)

FOREIGN PATENT DOCUMENTS

CA 2175065 5/1995
(Continued)

OTHER PUBLICATIONS

U.S. Appl. No. 11/530,311, filed Sep. 8, 2006.
(Continued)

*Primary Examiner* — Tony G Soohoo
(74) *Attorney, Agent, or Firm* — Armstrong Teasdale LLP

(57) ABSTRACT

An ultrasonic mixing system having a particulate dispensing system to dispense particulates into a treatment chamber and the treatment chamber in which particulates can be mixed with one or more formulations is disclosed. Specifically, the treatment chamber has an elongate housing through which a formulation and particulates flow longitudinally from an inlet port to an outlet port thereof. An elongate ultrasonic waveguide assembly extends within the housing and is operable at a predetermined ultrasonic frequency to ultrasonically energize the formulation and particulates within the housing. An elongate ultrasonic horn of the waveguide assembly is disposed at least in part intermediate the inlet and outlet ports, and has a plurality of discrete agitating members in contact with and extending transversely outward from the horn intermediate the inlet and outlet ports in longitudinally spaced relationship with each other. The horn and agitating members are constructed and arranged for dynamic motion of the agitating members relative to the horn at the predetermined frequency and to operate in an ultrasonic cavitation mode of the agitating members corresponding to the predetermined frequency and the formulation and particulates being mixed in the chamber.

25 Claims, 2 Drawing Sheets

U.S. PATENT DOCUMENTS

| | | | | | |
|---|---|---|---|---|---|
| 3,246,881 | A | | 4/1966 | Davidson et al. | |
| 3,249,453 | A | | 5/1966 | Schnoring et al. | |
| 3,273,631 | A | | 9/1966 | Neuman | |
| 3,275,787 | A | | 9/1966 | Newberry | |
| 3,278,165 | A | * | 10/1966 | Gaffney | 366/119 |
| 3,284,991 | A | | 11/1966 | Ploeger et al. | |
| 3,325,348 | A | | 6/1967 | Bennett | |
| 3,326,470 | A | | 6/1967 | Loudin et al. | |
| 3,338,992 | A | | 8/1967 | Kinney | |
| 3,341,394 | A | | 9/1967 | Kinney | |
| 3,425,951 | A | | 2/1969 | Ishiwata | |
| 3,463,321 | A | | 8/1969 | VanIngen | |
| 3,479,873 | A | | 11/1969 | Hermanns | |
| 3,490,584 | A | | 1/1970 | Balamuth | |
| 3,502,763 | A | | 3/1970 | Hartman | |
| 3,519,251 | A | | 7/1970 | Hammitt et al. | |
| 3,542,345 | A | | 11/1970 | Kuris | |
| 3,542,615 | A | | 11/1970 | Dobo et al. | |
| 3,567,185 | A | | 3/1971 | Ross et al. | |
| 3,591,946 | A | | 7/1971 | Loe | |
| 3,664,191 | A | | 5/1972 | Hermanns | |
| 3,692,618 | A | | 9/1972 | Dorschner et al. | |
| 3,782,547 | A | | 1/1974 | Dieter | |
| 3,802,817 | A | | 4/1974 | Matsuki et al. | |
| 3,865,350 | A | | 2/1975 | Burtis | |
| 3,873,071 | A | * | 3/1975 | Tatebe | 366/113 |
| 3,904,392 | A | | 9/1975 | VanIngen et al. | |
| 4,035,151 | A | * | 7/1977 | Czerny et al. | 422/232 |
| 4,062,768 | A | | 12/1977 | Elliot | |
| 4,070,167 | A | | 1/1978 | Barbee et al. | |
| 4,122,797 | A | | 10/1978 | Kawamura et al. | |
| 4,168,295 | A | | 9/1979 | Sawyer | |
| 4,218,221 | A | | 8/1980 | Cottell | |
| 4,249,986 | A | | 2/1981 | Obeda | |
| 4,259,021 | A | | 3/1981 | Goudy, Jr. | |
| 4,260,389 | A | | 4/1981 | Lister | |
| 4,266,879 | A | | 5/1981 | McFall | |
| 4,340,563 | A | | 7/1982 | Appel et al. | |
| 4,372,296 | A | | 2/1983 | Fahim | |
| 4,398,925 | A | | 8/1983 | Trinh et al. | |
| 4,425,718 | A | | 1/1984 | Kawaguchi | |
| 4,511,254 | A | | 4/1985 | North et al. | |
| 4,556,467 | A | | 12/1985 | Kuhn | |
| 4,612,016 | A | | 9/1986 | Jaeger et al. | |
| 4,612,018 | A | | 9/1986 | Tsuboi et al. | |
| 4,663,220 | A | | 5/1987 | Wisneski et al. | |
| 4,673,512 | A | | 6/1987 | Schram | |
| 4,693,879 | A | | 9/1987 | Yoshimura et al. | |
| 4,699,636 | A | | 10/1987 | Bofinger et al. | |
| 4,706,509 | A | | 11/1987 | Riebel | |
| 4,708,878 | A | | 11/1987 | Hagelauer et al. | |
| 4,726,522 | A | | 2/1988 | Kokubo et al. | |
| 4,743,361 | A | | 5/1988 | Schram | |
| 4,848,159 | A | | 7/1989 | Kennedy et al. | |
| 4,877,516 | A | | 10/1989 | Schram | |
| 4,879,011 | A | | 11/1989 | Schram | |
| 4,929,279 | A | | 5/1990 | Hays | |
| RE33,524 | E | | 1/1991 | Schram | |
| 4,983,045 | A | | 1/1991 | Taniguchi | |
| 5,006,266 | A | | 4/1991 | Schram | |
| 5,026,167 | A | | 6/1991 | Berliner, III | |
| 5,032,027 | A | | 7/1991 | Berliner, III | |
| 5,059,249 | A | | 10/1991 | Hays | |
| 5,096,532 | A | * | 3/1992 | Neuwirth et al. | 156/580.1 |
| 5,110,403 | A | * | 5/1992 | Ehlert | 156/580.1 |
| 5,122,165 | A | | 6/1992 | Wang et al. | |
| 5,164,094 | A | | 11/1992 | Stuckart | |
| 5,169,067 | A | | 12/1992 | Matsusaka et al. | |
| 5,242,557 | A | | 9/1993 | Jones et al. | |
| 5,258,413 | A | | 11/1993 | Isayev | |
| 5,269,297 | A | * | 12/1993 | Weng et al. | 606/128 |
| 5,326,164 | A | | 7/1994 | Logan | |
| 5,330,100 | A | | 7/1994 | Malinowski | |
| 5,335,449 | A | | 8/1994 | Beatty | |
| 5,372,634 | A | | 12/1994 | Monahan | |
| 5,373,212 | A | | 12/1994 | Beau | |
| 5,375,926 | A | * | 12/1994 | Omasa | 366/118 |
| 5,391,000 | A | | 2/1995 | Taniguchi | |
| 5,466,722 | A | | 11/1995 | Stoffer et al. | |
| 5,519,670 | A | | 5/1996 | Walter | |
| 5,536,921 | A | | 7/1996 | Hedrick et al. | |
| 5,583,292 | A | | 12/1996 | Karbach et al. | |
| 5,585,565 | A | | 12/1996 | Glascock et al. | |
| 5,665,383 | A | | 9/1997 | Grinstaff et al. | |
| 5,681,457 | A | | 10/1997 | Mahoney | |
| 5,711,888 | A | | 1/1998 | Trampler et al. | |
| 5,770,124 | A | | 6/1998 | Marecki et al. | |
| 5,803,270 | A | | 9/1998 | Brodeur | |
| 5,810,037 | A | | 9/1998 | Sasaki et al. | |
| 5,831,166 | A | | 11/1998 | Kozuka et al. | |
| 5,853,456 | A | | 12/1998 | Bryan et al. | |
| 5,868,153 | A | | 2/1999 | Cohen et al. | |
| 5,873,968 | A | | 2/1999 | Pike et al. | |
| 5,902,489 | A | | 5/1999 | Yasuda et al. | |
| 5,916,203 | A | | 6/1999 | Brandon et al. | |
| 5,922,355 | A | | 7/1999 | Parikh et al. | |
| 5,935,883 | A | | 8/1999 | Pike | |
| 5,937,906 | A | * | 8/1999 | Kozyuk | 138/37 |
| 5,964,926 | A | | 10/1999 | Cohen | |
| 5,979,664 | A | | 11/1999 | Brodeur | |
| 6,010,592 | A | | 1/2000 | Jameson et al. | |
| 6,020,277 | A | | 2/2000 | Jameson | |
| 6,035,897 | A | * | 3/2000 | Kozyuk | 138/37 |
| 6,053,028 | A | | 4/2000 | Kraus, Jr. et al. | |
| 6,053,424 | A | | 4/2000 | Gipson et al. | |
| 6,055,859 | A | | 5/2000 | Kozuka et al. | |
| 6,060,416 | A | | 5/2000 | Kobata | |
| 6,074,466 | A | | 6/2000 | Iwasa | |
| 6,090,731 | A | | 7/2000 | Pike et al. | |
| 6,106,590 | A | | 8/2000 | Ueno et al. | |
| 6,169,045 | B1 | | 1/2001 | Pike et al. | |
| 6,200,486 | B1 | | 3/2001 | Chahine et al. | |
| 6,218,483 | B1 | | 4/2001 | Muthiah et al. | |
| 6,221,258 | B1 | | 4/2001 | Feke et al. | |
| 6,254,787 | B1 | | 7/2001 | Kimura et al. | |
| 6,266,836 | B1 | | 7/2001 | Gallego Juarez et al. | |
| 6,315,215 | B1 | | 11/2001 | Gipson et al. | |
| 6,322,240 | B1 | * | 11/2001 | Omasa | 366/118 |
| 6,332,541 | B1 | | 12/2001 | Coakley et al. | |
| 6,361,697 | B1 | | 3/2002 | Coury et al. | |
| 6,368,414 | B1 | | 4/2002 | Johnson | |
| 6,380,264 | B1 | | 4/2002 | Jameson et al. | |
| 6,383,301 | B1 | | 5/2002 | Bell et al. | |
| 6,450,417 | B1 | | 9/2002 | Gipson et al. | |
| 6,467,350 | B1 | | 10/2002 | Kaduchak et al. | |
| 6,482,327 | B1 | | 11/2002 | Mori et al. | |
| 6,506,584 | B1 | | 1/2003 | Chandler et al. | |
| 6,547,903 | B1 | * | 4/2003 | McNichols et al. | 156/64 |
| 6,547,935 | B2 | | 4/2003 | Scott | |
| 6,547,951 | B1 | | 4/2003 | Maekawa | |
| 6,551,607 | B1 | | 4/2003 | Minerath, III | |
| 6,576,042 | B2 | | 6/2003 | Kraus et al. | |
| 6,582,611 | B1 | | 6/2003 | Kerfoot | |
| 6,593,436 | B2 | | 7/2003 | Austin et al. | |
| 6,605,252 | B2 | * | 8/2003 | Omasa | 422/20 |
| 6,620,226 | B2 | | 9/2003 | Hutton et al. | |
| 6,624,100 | B1 | | 9/2003 | Pike et al. | |
| 6,627,265 | B2 | | 9/2003 | Kutilek | |
| 6,655,826 | B1 | | 12/2003 | Leanos | |
| 6,659,365 | B2 | | 12/2003 | Gipson et al. | |
| 6,676,003 | B2 | | 1/2004 | Ehlert et al. | |
| 6,689,730 | B2 | | 2/2004 | Hortel et al. | |
| 6,739,524 | B2 | | 5/2004 | Taylor-McCune et al. | |
| 6,770,600 | B1 | | 8/2004 | Lamola | |
| 6,817,541 | B2 | | 11/2004 | Sands et al. | |
| 6,818,128 | B2 | | 11/2004 | Minter | |
| 6,837,445 | B1 | * | 1/2005 | Tsai | 239/102.2 |
| 6,841,921 | B2 | * | 1/2005 | Stegelmann | 310/323.19 |
| 6,858,181 | B2 | | 2/2005 | Aoyagi | |
| 6,878,288 | B2 | | 4/2005 | Scott | |
| 6,883,724 | B2 | | 4/2005 | Adiga et al. | |
| 6,890,593 | B2 | | 5/2005 | Tian | |
| 6,897,628 | B2 | | 5/2005 | Gunnerman | |
| 6,902,650 | B2 | | 6/2005 | Park et al. | |
| 6,911,153 | B2 | | 6/2005 | Minter | |
| 6,929,750 | B2 | | 8/2005 | Laurell et al. | |
| 6,935,770 | B2 | | 8/2005 | Schueler | |

| | | | | |
|---|---|---|---|---|
| 6,936,151 | B1 | 8/2005 | Lock | |
| 7,018,546 | B2 | 3/2006 | Kurihara et al. | |
| 7,083,322 | B2 * | 8/2006 | Moore et al. | 366/118 |
| 7,083,764 | B2 | 8/2006 | Scott | |
| 7,090,391 | B2 * | 8/2006 | Taniguchi | 366/118 |
| 7,108,137 | B2 | 9/2006 | Lal et al. | |
| 7,150,779 | B2 | 12/2006 | Meegan, Jr. | |
| 7,156,201 | B2 | 1/2007 | Peshkovskiy et al. | |
| 7,293,909 | B2 * | 11/2007 | Taniguchi | 366/118 |
| 7,322,431 | B2 | 1/2008 | Ratcliff | |
| 7,338,551 | B2 * | 3/2008 | Kozyuk | 95/175 |
| 7,404,666 | B2 * | 7/2008 | Tessien | 366/114 |
| 7,414,009 | B2 | 8/2008 | Tanaka et al. | |
| 7,419,519 | B2 | 9/2008 | Li et al. | |
| 7,424,883 | B2 | 9/2008 | McNichols et al. | |
| 7,465,426 | B2 | 12/2008 | Kerherve et al. | |
| 7,504,075 | B2 | 3/2009 | Marhasin | |
| 7,516,664 | B2 | 4/2009 | Meier et al. | |
| 7,533,830 | B1 | 5/2009 | Rose | |
| 7,582,156 | B2 | 9/2009 | Tanaka et al. | |
| 7,673,516 | B2 * | 3/2010 | Janssen et al. | 73/592 |
| 7,703,698 | B2 * | 4/2010 | Janssen et al. | 239/102.2 |
| 7,712,353 | B2 * | 5/2010 | Janssen et al. | 73/61.73 |
| 7,735,751 | B2 | 6/2010 | Ehlert et al. | |
| 7,780,743 | B2 | 8/2010 | Greaves et al. | |
| 7,785,674 | B2 | 8/2010 | Janssen et al. | |
| 2001/0040935 | A1 | 11/2001 | Case | |
| 2002/0036173 | A1 | 3/2002 | Feke et al. | |
| 2002/0164274 | A1 | 11/2002 | Haggett et al. | |
| 2003/0042174 | A1 | 3/2003 | Austin | |
| 2003/0047067 | A1 | 3/2003 | Kraus et al. | |
| 2003/0048692 | A1 | 3/2003 | Cohen et al. | |
| 2003/0051989 | A1 | 3/2003 | Austin | |
| 2003/0061939 | A1 | 4/2003 | Hutton et al. | |
| 2003/0066899 | A1 | 4/2003 | Gipson | |
| 2003/0116014 | A1 | 6/2003 | Possanza et al. | |
| 2003/0143110 | A1 | 7/2003 | Kritzler | |
| 2003/0194692 | A1 | 10/2003 | Purdum | |
| 2003/0234173 | A1 | 12/2003 | Minter | |
| 2004/0022695 | A1 | 2/2004 | Simon | |
| 2004/0065599 | A1 | 4/2004 | Lal et al. | |
| 2004/0079580 | A1 | 4/2004 | Manna et al. | |
| 2004/0120904 | A1 | 6/2004 | Lye et al. | |
| 2004/0142041 | A1 | 7/2004 | MacDonald et al. | |
| 2004/0187524 | A1 | 9/2004 | Sen et al. | |
| 2004/0202728 | A1 | 10/2004 | Shanker et al. | |
| 2005/0000914 | A1 | 1/2005 | Dahlberg et al. | |
| 2005/0008560 | A1 | 1/2005 | Kataoka et al. | |
| 2005/0017599 | A1 | 1/2005 | Puskas | |
| 2005/0025797 | A1 | 2/2005 | Wang | |
| 2005/0082234 | A1 | 4/2005 | Solenthaler | |
| 2005/0084438 | A1 | 4/2005 | Do et al. | |
| 2005/0084464 | A1 | 4/2005 | McGrath et al. | |
| 2005/0085144 | A1 | 4/2005 | MacDonald et al. | |
| 2005/0092931 | A1 | 5/2005 | Gadgil et al. | |
| 2005/0129161 | A1 | 6/2005 | Laberge | |
| 2005/0207431 | A1 | 9/2005 | Beca et al. | |
| 2005/0260106 | A1 | 11/2005 | Marhasin | |
| 2006/0000034 | A1 | 1/2006 | McGrath | |
| 2006/0008442 | A1 | 1/2006 | MacDonald et al. | |
| 2006/0120212 | A1 | 6/2006 | Taniguchi et al. | |
| 2007/0114306 | A1 | 5/2007 | Kawakami et al. | |
| 2007/0119785 | A1 | 5/2007 | Englehardt et al. | |
| 2007/0131034 | A1 * | 6/2007 | Ehlert et al. | 73/617 |
| 2007/0170277 | A1 | 7/2007 | Ehlert | |
| 2008/0061000 | A1 | 3/2008 | Janssen | |
| 2008/0062811 | A1 | 3/2008 | Janssen | |
| 2008/0063718 | A1 | 3/2008 | Janssen | |
| 2008/0067418 | A1 | 3/2008 | Ross | |
| 2008/0069887 | A1 | 3/2008 | Baran et al. | |
| 2008/0117711 | A1 * | 5/2008 | Omasa | 366/118 |
| 2008/0155763 | A1 | 7/2008 | Janssen et al. | |
| 2008/0156737 | A1 | 7/2008 | Janssen et al. | |
| 2008/0159063 | A1 | 7/2008 | Janssen et al. | |
| 2008/0192568 | A1 | 8/2008 | Hielscher et al. | |
| 2008/0251375 | A1 | 10/2008 | Hielscher et al. | |
| 2009/0014377 | A1 * | 1/2009 | Janssen et al. | 210/243 |
| 2009/0147905 | A1 | 6/2009 | Janssen et al. | |
| 2009/0155091 | A1 * | 6/2009 | Ehlert et al. | 417/53 |
| 2009/0158936 | A1 * | 6/2009 | Janssen et al. | 96/389 |
| 2009/0162258 | A1 * | 6/2009 | Janssen et al. | 422/186.3 |
| 2009/0165654 | A1 * | 7/2009 | Koenig et al. | 96/175 |
| 2009/0166177 | A1 * | 7/2009 | Wenzel et al. | 204/157.62 |
| 2009/0168590 | A1 * | 7/2009 | Koenig et al. | 366/114 |
| 2009/0262597 | A1 * | 10/2009 | Kieffer et al. | 366/116 |
| 2010/0150859 | A1 | 6/2010 | Do et al. | |
| 2010/0206742 | A1 | 8/2010 | Janssen et al. | |
| 2010/0296975 | A1 | 11/2010 | Peshkovsky et al. | |

FOREIGN PATENT DOCUMENTS

| | | | |
|---|---|---|---|
| CH | 657067 | | 8/1986 |
| CN | 1535249 | A | 10/2004 |
| CN | 1247628 | | 3/2006 |
| CN | 101153138 | | 4/2008 |
| DE | 2131878 | A1 | 2/1973 |
| DE | 262553 | A3 | 12/1988 |
| DE | 9017338 | | 3/1991 |
| DE | 4444525 | | 6/1996 |
| DE | 19854013 | | 5/2000 |
| DE | 19913397 | | 9/2000 |
| DE | 19938254 | | 2/2001 |
| DE | 10015144 | A1 | 10/2001 |
| DE | 29825063 | | 6/2004 |
| DE | 102004040233 | | 3/2006 |
| DE | 102005025118 | | 1/2007 |
| DE | 102005034629 | | 1/2007 |
| EP | 0269941 | A1 | 6/1988 |
| EP | 0292470 | | 11/1988 |
| EP | 347891 | | 12/1989 |
| EP | 457187 | A2 * | 11/1991 |
| EP | 0459967 | | 12/1991 |
| EP | 0625482 | | 11/1994 |
| EP | 0648531 | | 4/1995 |
| EP | 894612 | A2 * | 2/1999 |
| EP | 1954388 | | 3/2007 |
| EP | 0983968 | | 3/2008 |
| EP | 2173669 | A2 | 4/2010 |
| EP | 2176173 | A2 | 4/2010 |
| FR | 2793811 | | 11/2000 |
| FR | 2832703 | A1 | 5/2005 |
| GB | 1404575 | | 9/1975 |
| JP | 56028221 | | 3/1981 |
| JP | 57119853 | | 7/1982 |
| JP | 58034051 | | 2/1983 |
| JP | 62001413 | A | 1/1987 |
| JP | 62039839 | U | 3/1987 |
| JP | 6372364 | | 4/1988 |
| JP | 63104664 | | 5/1988 |
| JP | 1108081 | | 4/1989 |
| JP | 02281185 | A | 11/1990 |
| JP | 03053195 | A | 3/1991 |
| JP | 3086258 | | 4/1991 |
| JP | 03157129 | A * | 7/1991 |
| JP | 6228824 | | 8/1994 |
| JP | 8304388 | | 11/1996 |
| JP | 9286943 | | 11/1997 |
| JP | 10060331 | | 3/1998 |
| JP | 2000158364 | | 12/1999 |
| JP | 2001017970 | | 1/2001 |
| JP | 2003103152 | A | 4/2003 |
| JP | 2004256783 | | 9/2004 |
| KR | 20020073778 | A | 9/2002 |
| KR | 1020050013858 | A | 2/2005 |
| KR | 1020050113356 | A | 12/2005 |
| SU | 203582 | A | 1/1967 |
| WO | 9400757 | | 1/1994 |
| WO | 9429873 | A | 12/1994 |
| WO | 9600318 | | 1/1996 |
| WO | WO 9609112 | A1 * | 3/1996 |
| WO | 9933520 | | 7/1999 |
| WO | 0004978 | | 2/2000 |
| WO | 0041794 | | 7/2000 |
| WO | 0139200 | A | 5/2001 |
| WO | 0222252 | | 3/2002 |
| WO | WO 02080668 | A2 * | 10/2002 |
| WO | 03012800 | | 2/2003 |
| WO | 2004026452 | | 4/2004 |
| WO | 2004064487 | | 8/2004 |

| | | | |
|---|---|---|---|
| WO | 2005011804 | | 2/2005 |
| WO | 2006037591 | | 4/2006 |
| WO | 2006043970 | A2 | 4/2006 |
| WO | 2006073645 | A1 | 7/2006 |
| WO | 2006074921 | | 7/2006 |
| WO | WO 2006073645 | A1 * | 7/2006 |
| WO | 2006093804 | | 9/2006 |
| WO | 2007011520 | A2 | 1/2007 |
| WO | 2007060245 | A1 | 5/2007 |
| WO | 2007095871 | | 8/2007 |
| WO | 2008029379 | | 3/2008 |
| WO | 2008047259 | | 4/2008 |
| WO | 2008085806 | | 7/2008 |

OTHER PUBLICATIONS

Non-final office action regarding U.S. Appl. No. 11/617,515, dated Mar. 27, 2009.
International Search Report and Written Opinion regarding PCT/IB2007/054892 dated May 15, 2008.
International Search Report and Written Opinion regarding PCT/IB2007/054898 dated May 15, 2008.
Non-final office action regarding U.S. Appl. No. 11/530,311, dated Nov. 5, 2008.
International Search Report and Written Opinion regarding PCT/IB2008/052760, dated Feb. 17, 2009.
International Search Report and Written Opinion, PCT/IB2008/055051 (Feb. 20, 2009).
International Search Report and Written Opinion for PCT/IB2008/052764 mailed Apr. 2, 2009.
International Search Report and Written Opinion from PCT/IB2008/052766, dated Mar. 31, 2009.
Non-final office action regarding U.S. Appl. No. 11/950,943, dated May 1, 2009.
J.D. Lawson, "Some Criteria for a Power Producing Thermonuclear Reactor", Proc. Phys. Soc. B70, pp. 6-10 (1957).
L.A. Artsimovich, "Controlled Thermonuclear Reactions", Gordon and Breach Science Publishers, New York, first English translation, 1964.
D.R.O. Morrison, "Cold Fusion Update No. 9", Jan. 1994, from Newsgroups sci.physics.fusion, http://www.groups.google.com.
Brenner et al, Single-bubble sonoluminescence, Reviews of Modern Physics, vol. 74, Apr. 2002, pp. 425-484.
J. Lister, Plasma Physics and Controlled Fusion 48, pp. 715-716 (2006).
U.S. Department of Energy, "Report of the Review of Low Energy Nuclear Reactions", Dec. 1, 2004 (USDOE).
Final Office Action Regarding U.S. Appl. No. 11/530,311, dated Jun. 23, 2009.
Non-final office action regarding U.S. Appl. No. 11/617,497, dated Jun. 26, 2009.
International Search Report and Written Opinion regarding PCT/IB2008/055396, dated Jul. 29, 2009.
International Search Report and Written Opinion issued Aug. 18, 2009 for PCT/IB2008/055520.
International Search Report and Written Opinion issued Aug. 18, 2009 for PCT/IB2008/055517.
International Search Report and Written Opinion issued Aug. 18, 2009 for PCT/IB2008/055518.
International Search Report and Written Opinion regarding PCT/IB2008/055514, dated Aug. 25, 2009.
International Search Report and Written Opinion regarding PCT/IB2008/055395, dated Sep. 14, 2009.
International Search Report and Written Opinion regarding PCT/IB2008/055394, dated Sep. 28, 2009.
Blume, T. and Neis, U. "Improved wastewater disinfection by ultrasonic pre-treatment." Ultrasonics Sonochemistry, 2004, No. 11, pp. 333-336.
European Office Action regarding European Application No. 07805228.9, dated Oct. 9, 2009.
Non-final Office Action regarding U.S. Appl. No. 12/335,231, dated Oct. 15, 2009.
Non-final Office action regarding U.S. Appl. No. 11/530,183, dated Apr. 19, 2010.
Non-final Office Action in U.S. Appl. No. 11/966,458 mailed Sep. 28, 2010.
Takehi Moriguchi, et al. "Metal-modified silica adsorbents for removal of humic substances in water." Journal of Colloid and Interface Science 283, 2005 300-310, See Abstract, pp. 301 and 304.
International Search Report and Written Opinion regarding PCT/IB2009/055090, dated Jul. 16, 2010.
International Search Report and Written Opinion regarding PCT/IB2009/055092, dated Jul. 16, 2010.
Non-final Office action regarding U.S. Appl. No. 11/963,237, dated Jul. 8, 2010.
Non-Final Office action issued in related U.S. Appl. No. 11/777,140 on Aug. 9, 2010.
Non-Final Office action issued in related U.S. Appl. No. 11/966,447 on Aug. 2, 2010.
Oct. 27, 2010 Letter regarding the Office action issued for Mexican Patent Application Serial No. MX/a/2009/002519 mailed Oct. 12, 2010.
Kuo et al., "Nano-particles dispersion effect on Ni/Al2O3 Composite Coatings," Materials Chemistry and Physics, 86: 5-10 (2004).
Sivakumar et al., "Preparation of nanosized TiO2 supported on activated alumina by a sonochemical method: observation of an increased photocatalytic decolourisation efficiency," Research on Chemical Intermediates, 30(7-8): 785-792 (2004).
Non-final Office action issued in related U.S. Appl. No. 11/530,210 on Jun. 28, 2010.
Non-final Office action issued in related U.S. Appl. No. 11/530,210 on Dec. 1, 2010.
Final Office action issued in related U.S. Appl. No. 11/777,140 Dec. 1, 2010.
Non-final Office Action issued in U.S. Appl. No. 11/777,151 mailed Dec. 8, 2010.
International Search Report and Written Opinion from PCT/IB2007/052947 mailed Mar. 12, 2008.
Non-final Office action issued in U.S. Appl. No. 11/963,139, dated Feb. 18, 2011.
Non-final Office action issued in U.S. Appl. No. 11/777,140, dated Feb. 23, 2011.
Non-final Office Action submitted in U.S. Appl. No. 12/704,058 dated Dec. 9, 2010.
Non-final Office Action submitted in U.S. Appl. No. 11/530,183 dated Oct. 13, 2010.
Extended European Search Report in EP Patent Application No. 08789248.5 dated Nov. 30, 2011.
International Search Report and Written Opinion regarding PCT/IB2007/052945, dated Feb. 1, 2008.
International Search Report and Written Opinion regarding PCT/IB2007/052988, dated Feb. 14, 2008.
Taleyarkhan, et al., "Evidence for Nuclear Emissions During Acoustic Cavitation," Science, (Mar. 8, 2002), vol. 295, pp. 1868-1873.
Kloeppel, James E. "Temperature inside collapsing bubble four times that of the sun," News Bureau, University of Illinois at Urbana-Champaign.
Tal-Figiel B., The Formation of Stable W/O, O/W, W/O/W Cosmetic Emulsions in an Ultrasonic Field, viewed at http://www.atypon-link.com/ICHEME/doi/abs/10.1205/cherd06199 on Oct. 19, 2007.
"Controlled Thermonuclear Fusion" viewed at http://library.thinkquest.org/17940/texts/fusion_controlled/fusion_controlled.html on Oct. 23, 2007.
Flannigan, "Measurement of Pressure and Density Inside a Single Sonoluminescing Bubble," Physical Review Letters (May 26, 2006), PRL 96.
Taleyarkhan, et al. "Additional Evidence of Nuclear Emissions During Acoustic Cavitation," Physical Review E, (Mar. 2004). vol. 69.
"Thermonuclear Fusion Energy Source for Future Generations," viewed at http://nature.com/news/2006/060109/full/060109-5.html on May 4, 2007.
Lahey, Taleyarkhan, and Nigmatulin, "Bubble Power," IEEE spectrum, May 2005, pp. 39-43.
International Search Report and Written Opinion regarding PCT/IB2007/053621, dated Feb. 14, 2008.
International Search Report and Written Opinion regarding PCT/IB2007/053623, dated Feb. 14, 2008.

International Search Report and Written Opinion regarding PCT/IB2007/053622, dated Feb. 14, 2008.
U.S. Appl. No. 11/777,140, filed Jul. 12, 2007.
U.S. Appl. No. 11/617,497, filed Dec. 28, 2006.
U.S. Appl. No. 11/617,515, filed Dec. 28, 2006.
U.S. Appl. No. 11/777,151, filed Jul. 12, 2007.
U.S. Appl. No. 11/950,943, filed Dec. 5, 2007.
U.S. Appl. No. 11/963,139, filed Dec. 21, 2007.
U.S. Appl. No. 11/963,237, filed Dec. 21, 2007.
U.S. Appl. No. 11/966,458, filed Dec. 28, 2007.
U.S. Appl. No. 11/966,472, filed Dec. 28, 2007.
U.S. Appl. No. 11/966,447, filed Dec. 28, 2007.
U.S. Appl. No. 11/777,145, filed Dec. 12, 2007.
U.S. Appl. No. 11/965,435, filed Dec. 27, 2007.
Peplow, Mark, "Desktop fusion is back on the table," viewed at http//nature.com/news/2006/060109/full/060109-5.html on May 4, 2007.
Final Office Action Issued for U.S. Appl. No. 11/530,210 mailed Apr. 19, 2011.
First Office Action for China Patent Application No. 20088016947.3, dated Jun. 24, 2011.
First Office Action for Russian Patent Application No. 2009112526, dated Apr. 28, 2011.
Final Office Action issued for U.S. Appl. No. 11/530,210, mailed Jul. 1, 2011.
Non-Final Office Action issued for U.S. Appl. No. 12/335,231, mailed Jul. 13, 2011.
Non-Final Office Action issued for U.S. Appl. No. 12/335,176, mailed Jul. 13, 2011.
Non-Final Office Action issued for U.S. Appl. No. 11/963,139, mailed Jun. 15, 2011.
First Office Action for China Patent Application No. 200880121407.2, dated Aug. 24, 2011.
First Office Action for China Patent Application No. 200780033331.3, dated Nov. 14, 2011.
Non-final Office action regarding U.S. Appl. No. 11/965,435, dated Mar. 11, 2010.
English translation of Nagel WO 2006/074921 A1, accessed on the EPO website.
Compton R G et al., "Electrode Processes at the Surfaces of Sonotrodes," Electrochimica ACTA, vol. 41, No. 2, pp. 315-320 (Feb. 1, 1996).
Extended European Search Report received in EP Patent Application No. 08789246.9 mailed Nov. 30, 2011.
Final Office action issued in U.S. Appl. No. 11/966,447 mailed Jan. 5, 2011.
Supplementary European Search Report issued in EP Application No. 08789242 mailed Dec. 17, 2010.
Final Office Action issued in U.S. Appl. No. 11/966,458, dated Mar. 17, 2011.
Final Office Action issued in U.S. Appl. No. 11/530,183, dated Mar. 22, 2011.
Non-Final Office Action issued in U.S. Appl. No. 11/966,472, dated Mar. 31, 2011.
Final Office Action issued in U.S. Appl. No. 12/335,231, dated Mar. 31, 2011.
Barbaglia et al., "Search of Fusion Reactions During the Cavitation of a Single Bubble in Deuterated Liquids," Physica Scripta 72, pp. 75-78 (2005).

* cited by examiner

ULTRASONIC TREATMENT CHAMBER FOR PARTICLE DISPERSION INTO FORMULATIONS

FIELD OF DISCLOSURE

The present disclosure relates generally to systems for ultrasonically mixing particulates into various formulations. More particularly an ultrasonic mixing system is disclosed for ultrasonically mixing particulates, typically in powder-form, into formulations such as cosmetic formulations.

BACKGROUND OF DISCLOSURE

Powders and particulates are commonly added to formulations such as cosmetic formulations to provide various benefits, including, for example, absorbing water, modifying feel, thickening the formulation, and/or protecting skin. Although powders are useful, current mixing procedures have multiple problems such as dusting, clumping, and poor hydration, which can waste time, energy, and money for manufacturers of these formulations.

Specifically, formulations are currently prepared in a batch-type process, either by a cold mix or a hot mix procedure. The cold mix procedure generally consists of multiple ingredients or phases being added into a kettle in a sequential order with agitation being applied via a blade, baffles, or a vortex. The hot mix procedure is conducted similarly to the cold mix procedure with the exception that the ingredients or phases are generally heated above room temperature, for example to temperatures of from about 40 to about 100° C., prior to mixing, and are then cooled back to room temperature after the ingredients and phases have been mixed. In both procedures, powders (or other particulates) are added to the other ingredients manually by one of a number of methods including dumping, pouring, and/or sifting.

These conventional methods of mixing powders and particulates into formulations have several problems. For example, as noted above, all ingredients are manually added in a sequential sequence. Prior to adding the ingredients, each needs to be weighed, which can create human error. Specifically, as the ingredients need to be weighed one at a time, misweighing can occur with the additive amounts. Furthermore, by manually adding the ingredients, there is a risk of spilling or of incomplete transfers of the ingredients from one container to the next.

One other major issue with conventional methods of mixing powders into formulations is that batching processes require heating times, mixing times, and additive times that are entirely manual and left up to the individual compounders to follow the instructions. These practices can lead to inconsistencies from batch-to-batch and from compounder to compounder. Furthermore, these procedures required several hours to complete, which can get extremely expensive.

Based on the foregoing, there is a need in the art for a mixing system that provides ultrasonic energy to enhance the mixing of powders and particulates into formulations. Furthermore, it would be advantageous if the system could be configured to enhance the cavitation mechanism of the ultrasonics, thereby increasing the probability that the powders and particulates will be effectively mixed into the formulations.

SUMMARY OF DISCLOSURE

In one aspect, an ultrasonic mixing system for mixing particulates into a formulation generally comprises a treatment chamber comprising an elongate housing having longitudinally opposite ends and an interior space, and a particulate dispensing system for dispensing particulates into the treatment chamber. The housing of the treatment chamber is generally closed at at least one of its longitudinal ends and has at least one inlet port for receiving a formulation into the interior space of the housing and at least one outlet port through which a particulate-containing formulation is exhausted from the housing following ultrasonic mixing of the formulation and particulates. The outlet port is spaced longitudinally from the inlet port such that liquid flows longitudinally within the interior space of the housing from the inlet port to the outlet port. In one embodiment, the housing includes two separate ports for receiving separate components of the formulation. At least one elongate ultrasonic waveguide assembly extends longitudinally within the interior space of the housing and is operable at a predetermined ultrasonic frequency to ultrasonically energize and mix the formulation and the particulates flowing within the housing.

The waveguide assembly comprises an elongate ultrasonic horn disposed at least in part intermediate the inlet port and the outlet port of the housing and has an outer surface located for contact with the formulation and particulates flowing within the housing from the inlet port to the outlet port. A plurality of discrete agitating members are in contact with and extend transversely outward from the outer surface of the horn intermediate the inlet port and the outlet port in longitudinally spaced relationship with each other. The agitating members and the horn are constructed and arranged for dynamic motion of the agitating members relative to the horn upon ultrasonic vibration of the horn at the predetermined frequency and to operate in an ultrasonic cavitation mode of the agitating members corresponding to the predetermined frequency and the formulation being mixed with particulates in the chamber.

As such the present disclosure is directed to an ultrasonic mixing system for mixing particulates into a formulation. The mixing system comprises a treatment chamber and a particulate dispensing system capable of dispensing particulates into the treatment chamber for mixing with the formulation. The treatment chamber generally comprises an elongate housing having longitudinally opposite ends and an interior space, and an elongate ultrasonic waveguide assembly extending longitudinally within the interior space of the housing and being operable at a predetermined ultrasonic frequency to ultrasonically energize and mix the formulation and particulates flowing within the housing. The housing is generally closed at at least one of its longitudinal ends and has at least one inlet port for receiving a formulation into the interior space of the housing and at least one outlet port through which a particulate-containing formulation is exhausted from the housing following ultrasonic mixing of the formulation and particulates. The outlet port is spaced longitudinally from the inlet port such that liquid flows longitudinally within the interior space of the housing from the inlet port to the outlet port.

The waveguide assembly comprises an elongate ultrasonic horn disposed at least in part intermediate the inlet port and the outlet port of the housing and having an outer surface located for contact with the formulation and particulates flowing within the housing from the inlet port to the outlet port. Additionally, the waveguide assembly comprises a plurality of discrete agitating members in contact with and extending transversely outward from the outer surface of the horn intermediate the inlet port and the outlet port in longitudinally spaced relationship with each other. The agitating members and the horn are constructed and arranged for dynamic motion of the agitating members relative to the horn upon ultrasonic vibration of the horn at the predetermined frequency and to operate in an ultrasonic cavitation mode of the agitating members corresponding to the predetermined frequency and the formulation and particulates being mixed in the chamber.

The present invention is further directed to an ultrasonic mixing system for mixing particulates into a formulation. The mixing system comprises a treatment chamber and a particulate dispensing system capable of dispensing particulates into the treatment chamber for mixing with the formulation. The treatment chamber generally comprises an elongate housing having longitudinally opposite ends and an interior space, and an elongate ultrasonic waveguide assembly extending longitudinally within the interior space of the housing and being operable at a predetermined ultrasonic frequency to ultrasonically energize and mix the formulation and particulates flowing within the housing. The housing is generally closed at at least one of its longitudinal ends and has at least one inlet port for receiving a formulation into the interior space of the housing and at least one outlet port through which a particulate-containing formulation is exhausted from the housing following ultrasonic mixing of the formulation and particulates. The outlet port is spaced longitudinally from the inlet port such that liquid flows longitudinally within the interior space of the housing from the inlet port to the outlet port.

The waveguide assembly comprises an elongate ultrasonic horn disposed at least in part intermediate the inlet port and the outlet port of the housing and having an outer surface located for contact with the formulation and particulates flowing within the housing from the inlet port to the outlet port; a plurality of discrete agitating members in contact with and extending transversely outward from the outer surface of the horn intermediate the inlet port and the outlet port in longitudinally spaced relationship with each other; and a baffle assembly disposed within the interior space of the housing and extending at least in part transversely inward from the housing toward the horn to direct longitudinally flowing liquid in the housing to flow transversely inward into contact with the agitating members. The agitating members and the horn are constructed and arranged for dynamic motion of the agitating members relative to the horn upon ultrasonic vibration of the horn at the predetermined frequency and to operate in an ultrasonic cavitation mode of the agitating members corresponding to the predetermined frequency and the formulation and particulates being mixed in the chamber.

The present disclosure is further directed to a method for mixing particulates into a formulation using the ultrasonic mixing system described above. The method comprises delivering particulates to an intake zone within the interior space of the housing of the treatment chamber; delivering a formulation via the inlet port into the interior space of the housing; and ultrasonically mixing the particulates and formulation via the elongate ultrasonic waveguide assembly operating in the predetermined ultrasonic frequency. The intake zone is defined as the space between a terminal end of the horn within the interior space of the housing and the inlet port.

Other features of the present disclosure will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
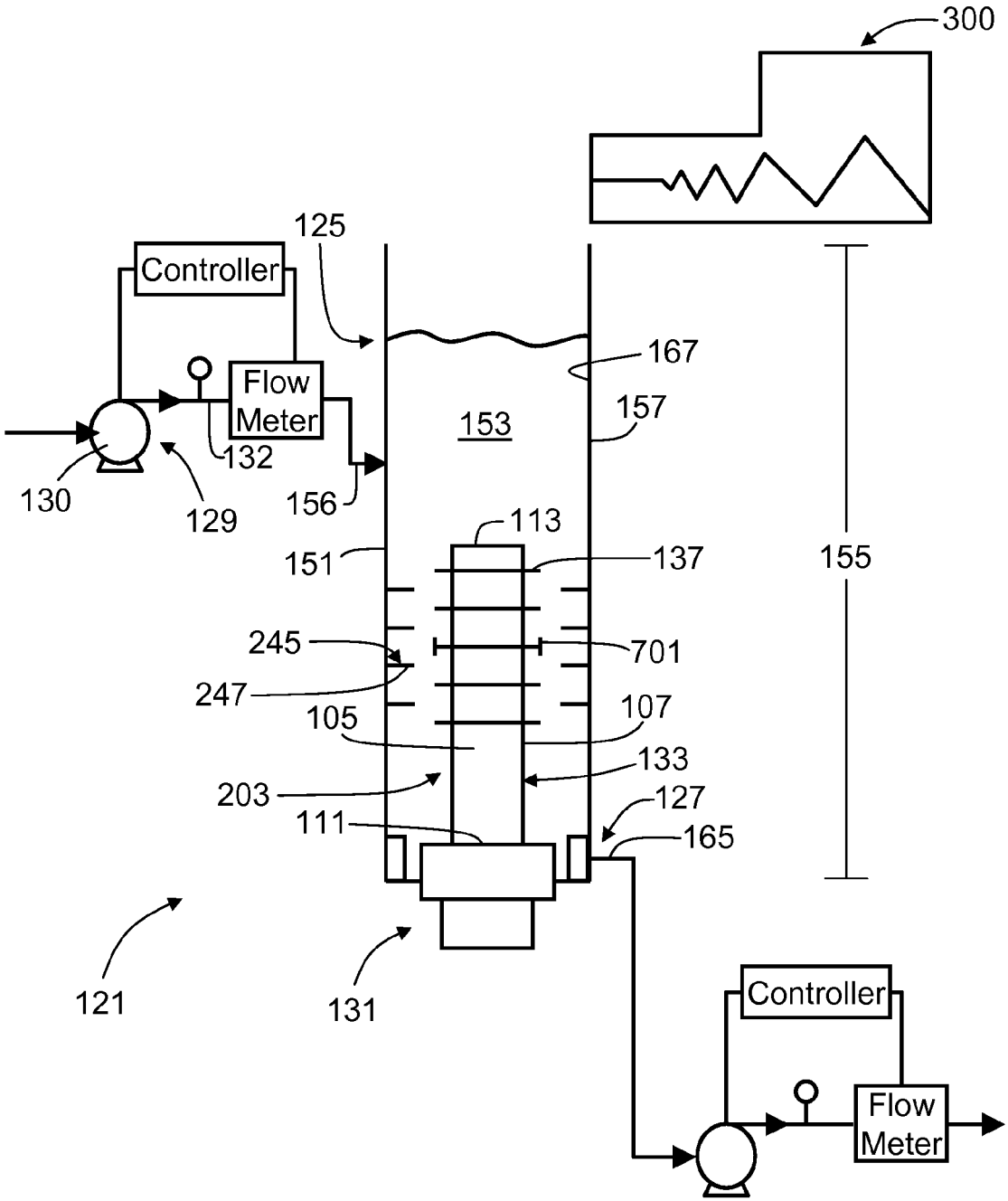
FIG. 1 is a schematic of an ultrasonic mixing system according to a first embodiment of the present disclosure for mixing particulates with a formulation.

With particular reference now to FIG. 1, in one embodiment, an ultrasonic mixing system for mixing particulates into a formulation generally comprises a particulate dispensing system, generally indicated at 300, for dispensing particulates into a treatment chamber and the treatment chamber, generally indicated at 151, that is operable to ultrasonically mix particulates with at least one formulation, and further is capable of creating a cavitation mode that allows for better mixing within the housing 151 of the chamber.

It is generally believed that as ultrasonic energy is created by the waveguide assembly, increased cavitation of the formulation occurs, creating microbubbles. As these microbubbles then collapse, the pressure within the formulation is increased forcibly dispersing the particulates within and throughout the formulation.

The term "liquid" and "formulation" are used interchangeably to refer to a single component formulation, a formulation comprised of two or more components in which at least one of the components is a liquid such as a liquid-liquid formulation or a liquid-gas formulation.

The ultrasonic mixing system 121 is illustrated schematically in FIG. 1 and is shown including a particulate dispensing system (generally indicated in FIG. 1 at 300). The particulate dispensing system can be any suitable dispensing system known in the art. Typically, the particulate dispensing system delivers particulates to the treatment chamber in the inlet end, upstream of the inlet port. With this configuration, the particulates will descend downward and initiate mixing with the formulation in the intake zone due to the swirling action as described more fully above. Further mixing between the particulates and formulation will occur around the outer surface of the horn of the waveguide assembly. In one particularly preferred embodiment, the particulate dispensing system may include an agar to dispense the particulates in a controlled rate; suitably, the rate is precision-based on weight. In another embodiment, the particulate dispensing system includes one or more pumps for pumping the particulates into the treatment chamber.

Typically, the flow rate of particulates into the treatment chamber is from about 1 gram per minute to about 1,000 grams per minute. More suitably, the particulates are delivered to the treatment chamber at a flow rate of from about 5 grams per minute to about 500 grams per minute.

The ultrasonic mixing system of FIG. 1 is further described herein with reference to use of the treatment chamber in the ultrasonic mixing system to mix particulates into a formulation to create a particulate-containing formulation. The particulate-containing formulation can subsequently provide formulations such as cosmetic formulations with improved feel, water absorption, thickening, and/or skin benefits to a user's skin. For example, in one embodiment, the cosmetic formulation can be a skin care lotion and the particulate contained within the particulate-containing formulation can be a sun protection agent to protect the user's skin from the damaging effects of the sun. It should be understood by one skilled in the art, however, that while described herein with respect to cosmetic formulations, the ultrasonic mixing system can be used to mix particulates into various other formulations. For example, other suitable formulations can include hand sanitizers, animate and inanimate surface cleansers, wet wipe solutions, suntan lotions, paints, inks, coatings, and polishes for both industrial and consumer products.

The particulates can be any particulate or dispersion that can improve the functionality and/or aesthetics of a formulation. Typically, the particulates are solid particles, however, it should be understood that the particulates can be particulate powders, liquid dispersions, encapsulated liquids, and the like. Examples of suitable particulates to mix with the formulations using the ultrasonic mixing system of the present disclosure can include rheology modifying particulates, such as cellulosics (e.g., hydroxyethyl cellulose, hydroxypropyl methylcellulose), gums (e.g., guar gums, acacia gums), acrylates (e.g., Carbomer 980 and Pemulen TR1 (both commercially available from Noveon, Cleveland, Ohio)), colloidal silica, and fumed silica, that can be mixed with the formulation to improve viscosity. Additionally, starches (e.g., corn starch, tapioca starch, rice starch), polymethyl methacylate, polymethylsilsequioxane, boron nitride, lauroyl lysine, acrylates, acrylate copolymers (e.g., methylmethacrylate cross-polymers), nylon-12 nylon-6, polyethylene, talc, styrene, silicone resin, polystyrene, polypropylene, ethylene/acrylic acid copolymer, bismuth oxychloride, mica, surface-treated mica, silica, and silica silyate can be mixed with one or more formulations to improve the skin-feel of a formulation. Other suitable particulates can include sensory enhancers, pigments (e.g., zinc oxide, titanium dioxide, iron oxide, zirconium oxide, barium sulfate, bismuth oxychloride, aluminum oxide, barium sulfate), lakes such as Blue 1 Lake and Yellow 5 Lake, dyes such as FD&C Yellow No. 5, FD&C Blue No. 1, D&C Orange No. 5, abrasives, absorbents, anti-caking, anti-acne, anti-dandruff, anti-perspirant, binders, bulking agents, colorants, deodorants, exfoliants, opacifying agents, oral care agents, skin protectants, slip modifiers, suspending agents, warming agents (e.g., magnesium chloride, magnesium sulfate, calcium chloride), and any other suitable particulates known in the art.

In some embodiments, as noted above, the particulates can be coated or encapsulated. The coatings can be hydrophobic or hydrophilic, depending upon the individual particulates and the formulation with which the particulates are to be mixed. Examples of encapsulation coatings include cellulose-based polymeric materials (e.g., ethyl cellulose), carbohydrate-based materials (e.g., cationic starches and sugars), polyglycolic acid, polylactic acid, and lactic acid-based aliphatic polyesters, and materials derived therefrom (e.g., dextrins and cyclodextrins) as well as other materials compatible with human tissues.

The encapsulation coating thickness may vary depending upon the particulate's composition, and is generally manufactured to allow the encapsulated particulate to be covered by a thin layer of encapsulation material, which may be a monolayer or thicker laminate layer, or may be a composite layer. The encapsulation coating should be thick enough to resist cracking or breaking of the coating during handling or shipping of the product. The encapsulation coating should be constructed such that humidity from atmospheric conditions during storage, shipment, or wear will not cause a breakdown of the encapsulation coating and result in a release of the particulate.

Encapsulated particulates should be of a size such that the user cannot feel the encapsulated particulate in the formulation when used on the skin. Typically, the encapsulated particulates have a diameter of no more than about 25 micrometers, and desirably no more than about 10 micrometers. At these sizes, there is no "gritty" or "scratchy" feeling when the particulate-containing formulation contacts the skin.

In one particularly preferred embodiment, as illustrated in FIG. 1, the treatment chamber 151 is generally elongate and has a general inlet end 125 (an upper end in the orientation of the illustrated embodiment) and a general outlet end 127 (a lower end in the orientation of the illustrated embodiment). The treatment chamber 151 is configured such that liquid (e.g., formulation) enters the treatment chamber 151 generally at the inlet end 125 thereof, flows generally longitudinally within the chamber (e.g., downward in the orientation of illustrated embodiment) and exits the chamber generally at the outlet end 127 of the chamber.

The terms "upper" and "lower" are used herein in accordance with the vertical orientation of the treatment chamber 151 illustrated in the various drawings and are not intended to describe a necessary orientation of the chamber in use. That is, while the chamber 151 is most suitably oriented vertically, with the outlet end 127 of the chamber below the inlet end 125 as illustrated in the drawing, it should be understood that the chamber may be oriented with the inlet end below the outlet end, or it may be oriented other than in a vertical orientation and remain within the scope of this disclosure.

The terms "axial" and "longitudinal" refer directionally herein to the vertical direction of the chamber 151 (e.g., end-to-end such as the vertical direction in the illustrated embodiment of FIG. 1). The terms "transverse", "lateral" and "radial" refer herein to a direction normal to the axial (e.g., longitudinal) direction. The terms "inner" and "outer" are also used in reference to a direction transverse to the axial direction of the treatment chamber 151, with the term "inner" referring to a direction toward the interior of the chamber and the term "outer" referring to a direction toward the exterior of the chamber.

The inlet end 125 of the treatment chamber 151 is in fluid communication with a suitable delivery system, generally indicated at 129, that is operable to direct one or more formulations to, and more suitably through, the chamber 151. Typically, the delivery system 129 may comprise one or more pumps 130 operable to pump the respective formulation from a corresponding source thereof to the inlet end 125 of the chamber 151 via suitable conduits 132.

It is understood that the delivery system 129 may be configured to deliver more than one formulation, or more than one component for a single formulation, such as when mixing the components to create the formulation, to the treatment chamber 151 without departing from the scope of this disclosure. It is also contemplated that delivery systems other than that illustrated in FIG. 1 and described herein may be used to deliver one or more formulations to the inlet end 125 of the treatment chamber 151 without departing from the scope of this disclosure. It should be understood that more than one formulation can refer to two streams of the same formulation or different formulations being delivered to the inlet end of the treatment chamber without departing from the scope of the present disclosure.

The treatment chamber 151 comprises a housing defining an interior space 153 of the chamber 151 through which a formulation delivered to the chamber 151 flows from the inlet end 125 to the outlet end 127 thereof. The housing 151 suitably comprises an elongate tube 155 generally defining, at least in part, a sidewall 157 of the chamber 151. The tube 155 may have one or more inlet ports (generally indicated in FIG. 1 at 156) formed therein through which one or more formulations to be mixed with particulates within the chamber 151 are delivered to the interior space 153 thereof. It should be understood by one skilled in the art that the inlet end of the housing may include more than one port (see FIG. 2), more than two ports, and even more than three ports. For example, although not shown, the housing may comprise three inlet ports, wherein the first inlet port and the second inlet port are suitably in parallel, spaced relationship with each other, and the third inlet port is oriented on the opposite sidewall of the housing from the first and second inlet ports.

As shown in FIG. 1, the inlet end 125 is open to the surrounding environment. In an alternative embodiment (not shown), however, the housing may comprise a closure connected to and substantially closing the longitudinally opposite end of the sidewall, and having at least one inlet port therein to generally define the inlet end of the treatment chamber. The sidewall (e.g., defined by the elongate tube) of the chamber has an inner surface that together with the waveguide assembly (as described below) and the closure define the interior space of the chamber.

In the illustrated embodiment of FIG. 1, the tube 155 is generally cylindrical so that the chamber sidewall 157 is generally annular in cross-section. However, it is contemplated that the cross-section of the chamber sidewall 157 may be other than annular, such as polygonal or another suitable shape, and remains within the scope of this disclosure. The chamber sidewall 157 of the illustrated chamber 151 is suitably constructed of a transparent material, although it is understood that any suitable material may be used as long as the material is compatible with the formulations and particulates being mixed within the chamber, the pressure at which the chamber is intended to operate, and other environmental conditions within the chamber such as temperature.

A waveguide assembly, generally indicated at 203, extends longitudinally at least in part within the interior space 153 of the chamber 151 to ultrasonically energize the formulation (and any of its components) and the particulates flowing through the interior space 153 of the chamber 151. In particular, the waveguide assembly 203 of the illustrated embodiment extends longitudinally from the lower or outlet end 127 of the chamber 151 up into the interior space 153 thereof to a terminal end 113 of the waveguide assembly disposed intermediate the inlet port (e.g., inlet port 156 where it is present). Although illustrated in FIG. 1 as extending longitudinally into the interior space 153 of the chamber 151, it should be understood by one skilled in the art that the waveguide assembly may extend laterally from a housing sidewall of the chamber, running horizontally through the interior space thereof without departing from the scope of the present disclosure. Typically, the waveguide assembly 203 is mounted, either directly or indirectly, to the chamber housing 151 as will be described later herein.

Still referring to FIG. 1, the waveguide assembly 203 suitably comprises an elongate horn assembly, generally indicated at 133, disposed entirely with the interior space 153 of the housing 151 intermediate the inlet port 156 and the outlet port 165 for complete submersion within the liquid being treated within the chamber 151, and more suitably, in the illustrated embodiment, it is aligned coaxially with the chamber sidewall 157. The horn assembly 133 has an outer surface 107 that together with an inner surface 167 of the sidewall 157 defines a flow path within the interior space 153 of the chamber 151 along which the formulation (and its components), and the particulates flow past the horn within the chamber (this portion of the flow path being broadly referred to herein as the ultrasonic treatment zone). The horn assembly 133 has an upper end defining a terminal end of the horn assembly (and therefore the terminal end 113 of the waveguide assembly) and a longitudinally opposite lower end 111. Although not shown, it is particularly preferable that the waveguide assembly 203 also comprises a booster coaxially aligned with and connected at an upper end thereof to the lower end 111 of the horn assembly 133. It is understood, however, that the waveguide assembly 203 may comprise only the horn assembly 133 and remain within the scope of this disclosure. It is also contemplated that the booster may be disposed entirely exterior of the chamber housing 151, with the horn assembly 133 mounted on the chamber housing 151 without departing from the scope of this disclosure.

The waveguide assembly 203, and more particularly the booster is suitably mounted on the chamber housing 151, e.g., on the tube 155 defining the chamber sidewall 157, at the upper end thereof by a mounting member (not shown) that is configured to vibrationally isolate the waveguide assembly (which vibrates ultrasonically during operation thereof) from the treatment chamber housing. That is, the mounting member inhibits the transfer of longitudinal and transverse mechanical vibration of the waveguide assembly 203 to the chamber housing 151 while maintaining the desired transverse position of the waveguide assembly (and in particular the horn assembly 133) within the interior space 153 of the chamber housing and allowing both longitudinal and transverse displacement of the horn assembly within the chamber housing. The mounting member also at least in part (e.g., along with the booster, lower end of the horn assembly, and/or closure 163) closes the outlet end 127 of the chamber 151. Examples of suitable mounting member configurations are illustrated and described in U.S. Pat. No. 6,676,003, the entire disclosure of which is incorporated herein by reference to the extent it is consistent herewith.

In one particularly suitable embodiment the mounting member is of single piece construction. Even more suitably the mounting member may be formed integrally with the booster (and more broadly with the waveguide assembly 203). However, it is understood that the mounting member may be constructed separately from the waveguide assembly 203 and remain within the scope of this disclosure. It is also understood that one or more components of the mounting member may be separately constructed and suitably connected or otherwise assembled together.

In one suitable embodiment, the mounting member is further constructed to be generally rigid (e.g., resistant to static displacement under load) so as to hold the waveguide assembly 203 in proper alignment within the interior space 153 of the chamber 151. For example, the rigid mounting member in one embodiment may be constructed of a non-elastomeric material, more suitably metal, and even more suitably the same metal from which the booster (and more broadly the waveguide assembly 203) is constructed. The term "rigid" is not, however, intended to mean that the mounting member is incapable of dynamic flexing and/or bending in response to ultrasonic vibration of the waveguide assembly 203. In other embodiments, the rigid mounting member may be constructed of an elastomeric material that is sufficiently resistant to static displacement under load but is otherwise capable of dynamic flexing and/or bending in response to ultrasonic vibration of the waveguide assembly 203.

A suitable ultrasonic drive system 131 including at least an exciter (not shown) and a power source (not shown) is disposed exterior of the chamber 151 and operatively connected to the booster (not shown) (and more broadly to the waveguide assembly 203) to energize the waveguide assembly to mechanically vibrate ultrasonically. Examples of suitable ultrasonic drive systems 131 include a Model 20A3000 system available from Dukane Ultrasonics of St. Charles, Ill., and a Model 2000CS system available from Herrmann Ultrasonics of Schaumberg, Ill.

In one embodiment, the drive system 131 is capable of operating the waveguide assembly 203 at a frequency in the range of about 15 kHz to about 100 kHz, more suitably in the range of about 15 kHz to about 60 kHz, and even more suitably in the range of about 20 kHz to about 40 kHz. Such ultrasonic drive systems 131 are well known to those skilled in the art and need not be further described herein.

In some embodiments, however not illustrated, the treatment chamber can include more than one waveguide assembly having at least two horn assemblies for ultrasonically treating and mixing the formulation and particulates. As noted above, the treatment chamber comprises a housing defining an interior space of the chamber through which the formulation and particulates are delivered from an inlet end. The housing comprises an elongate tube defining, at least in part, a sidewall of the chamber. As with the embodiment including only one waveguide assembly as described above, the tube may have one or more inlet ports formed therein, through which one or more formulations and particulates to be mixed within the chamber are delivered to the interior space thereof, and at least one outlet port through which the particulates-containing formulation exits the chamber.

In such an embodiment, two or more waveguide assemblies extend longitudinally at least in part within the interior space of the chamber to ultrasonically energize and mix the formulation and particulates flowing through the interior space of the chamber. Each waveguide assembly separately includes an elongate horn assembly, each disposed entirely within the interior space of the housing intermediate the inlet port and the outlet port for complete submersion within the formulation being mixed with the particulates within the chamber. Each horn assembly can be independently constructed as described more fully herein (including the horns, along with the plurality of agitating members and baffle assemblies).

Referring back to FIG. 1, the horn assembly 133 comprises an elongate, generally cylindrical horn 105 having an outer surface 107, and two or more (i.e., a plurality of) agitating members 137 connected to the horn and extending at least in part transversely outward from the outer surface of the horn in longitudinally spaced relationship with each other. The horn 105 is suitably sized to have a length equal to about one-half of the resonating wavelength (otherwise commonly referred to as one-half wavelength) of the horn. In one particular embodiment, the horn 105 is suitably configured to resonate in the ultrasonic frequency ranges recited previously, and most suitably at 20 kHz. For example, the horn 105 may be suitably constructed of a titanium alloy (e.g., $Ti_6Al_4V$) and sized to resonate at 20 kHz. The one-half wavelength horn 105 operating at such frequencies thus has a length (corresponding to a one-half wavelength) in the range of about 4 inches to about 6 inches, more suitably in the range of about 4.5 inches to about 5.5 inches, even more suitably in the range of about 5.0 inches to about 5.5 inches, and most suitably a length of about 5.25 inches (133.4 mm). It is understood, however, that the treatment chamber 151 may include a horn 105 sized to have any increment of one-half wavelength without departing from the scope of this disclosure.

In one embodiment (not shown), the agitating members 137 comprise a series of five washer-shaped rings that extend continuously about the circumference of the horn in longitudinally spaced relationship with each other and transversely outward from the outer surface of the horn. In this manner the vibrational displacement of each of the agitating members relative to the horn is relatively uniform about the circumference of the horn. It is understood, however, that the agitating members need not each be continuous about the circumference of the horn. For example, the agitating members may instead be in the form of spokes, blades, fins or other discrete structural members that extend transversely outward from the outer surface of the horn. For example, as illustrated in FIG. 1, one of the five agitating members is in a T-shape 701. Specifically, the T-shaped agitating member 701 surrounds the nodal region. It has been found that members in the T-shape, generate a strong radial (e.g., horizontal) acoustic wave that further increases the cavitation effect as described more fully herein.

By way of a dimensional example, the horn assembly 133 of the illustrated embodiment of FIG. 1 has a length of about 5.25 inches (133.4 mm), one of the rings 137 is suitably disposed adjacent the terminal end 113 of the horn 105 (and hence of the waveguide assembly 203), and more suitably is longitudinally spaced approximately 0.063 inches (1.6 mm) from the terminal end of the horn 105. In other embodiments the uppermost ring may be disposed at the terminal end of the horn 105 and remain within the scope of this disclosure. The rings 137 are each about 0.125 inches (3.2 mm) in thickness and are longitudinally spaced from each other (between facing surfaces of the rings) a distance of about 0.875 inches (22.2 mm).

It is understood that the number of agitating members 137 (e.g., the rings in the illustrated embodiment) may be less than or more than five without departing from the scope of this disclosure. It is also understood that the longitudinal spacing between the agitating members 137 may be other than as illustrated in FIG. 1 and described above (e.g., either closer or spaced further apart). Furthermore, while the rings 137 illustrated in FIG. 1 are equally longitudinally spaced from each other, it is alternatively contemplated that where more than two agitating members are present the spacing between longitudinally consecutive agitating members need not be uniform to remain within the scope of this disclosure.

In particular, the locations of the agitating members 137 are at least in part a function of the intended vibratory displacement of the agitating members upon vibration of the horn assembly 133. For example, in the illustrated embodiment of FIG. 1, the horn assembly 133 has a nodal region located generally longitudinally centrally of the horn 105 (e.g., at the third ring). As used herein and more particularly shown in FIG. 1, the "nodal region" of the horn 105 refers to a longitudinal region or segment of the horn member along which little (or no) longitudinal displacement occurs during ultrasonic vibration of the horn and transverse (e.g., radial in the illustrated embodiment) displacement of the horn is generally maximized. Transverse displacement of the horn assembly 133 suitably comprises transverse expansion of the horn but may also include transverse movement (e.g., bending) of the horn.

In the illustrated embodiment of FIG. 1, the configuration of the one-half wavelength horn 105 is such that the nodal region is particularly defined by a nodal plane (i.e., a plane transverse to the horn member at which no longitudinal displacement occurs while transverse displacement is generally maximized) is present. This plane is also sometimes referred to as a "nodal point". Accordingly, agitating members 137 (e.g., in the illustrated embodiment, the rings) that are disposed longitudinally further from the nodal region of the horn 105 will experience primarily longitudinal displacement while agitating members that are longitudinally nearer to the nodal region will experience an increased amount of transverse displacement and a decreased amount of longitudinal displacement relative to the longitudinally distal agitating members.

It is understood that the horn 105 may be configured so that the nodal region is other than centrally located longitudinally on the horn member without departing from the scope of this disclosure. It is also understood that one or more of the agitating members 137 may be longitudinally located on the horn so as to experience both longitudinal and transverse displacement relative to the horn upon ultrasonic vibration of the horn 105.

Still referring to FIG. 1, the agitating members 137 are sufficiently constructed (e.g., in material and/or dimension such as thickness and transverse length, which is the distance that the agitating member extends transversely outward from the outer surface 107 of the horn 105) to facilitate dynamic motion, and in particular dynamic flexing/bending of the agitating members in response to the ultrasonic vibration of the horn. In one particularly suitable embodiment, for a given ultrasonic frequency at which the waveguide assembly 203 is to be operated in the treatment chamber (otherwise referred to herein as the predetermined frequency of the waveguide assembly) and a particular liquid to be treated within the chamber 151, the agitating members 137 and horn 105 are suitably constructed and arranged to operate the agitating members in what is referred to herein as an ultrasonic cavitation mode at the predetermined frequency.

As used herein, the ultrasonic cavitation mode of the agitating members refers to the vibrational displacement of the agitating members sufficient to result in cavitation (i.e., the formation, growth, and implosive collapse of bubbles in a liquid) of the formulation being treated at the predetermined ultrasonic frequency. For example, where the formulation (and particulates) flowing within the chamber comprises an aqueous liquid formulation, and the ultrasonic frequency at which the waveguide assembly 203 is to be operated (i.e., the predetermined frequency) is about 20 kHZ, one or more of the agitating members 137 are suitably constructed to provide a vibrational displacement of at least 1.75 mils (i.e., 0.00175 inches, or 0.044 mm) to establish a cavitation mode of the agitating members.

It is understood that the waveguide assembly 203 may be configured differently (e.g., in material, size, etc.) to achieve a desired cavitation mode associated with the particular formulation and/or particulates to be mixed. For example, as the viscosity of the formulation being mixed with the particulates changes, the cavitation mode of the agitating members may need to be changed.

In particularly suitable embodiments, the cavitation mode of the agitating members corresponds to a resonant mode of the agitating members whereby vibrational displacement of the agitating members is amplified relative to the displacement of the horn. However, it is understood that cavitation may occur without the agitating members operating in their resonant mode, or even at a vibrational displacement that is greater than the displacement of the horn, without departing from the scope of this disclosure.

In one suitable embodiment, a ratio of the transverse length of at least one and, more suitably, all of the agitating members to the thickness of the agitating member is in the range of about 2:1 to about 6:1. As another example, the rings each extend transversely outward from the outer surface 107 of the horn 105 a length of about 0.5 inches (12.7 mm) and the thickness of each ring is about 0.125 inches (3.2 mm), so that the ratio of transverse length to thickness of each ring is about 4:1. It is understood, however that the thickness and/or the transverse length of the agitating members may be other than that of the rings as described above without departing from the scope of this disclosure. Also, while the agitating members 137 (rings) may suitably each have the same transverse length and thickness, it is understood that the agitating members may have different thicknesses and/or transverse lengths.

In the above described embodiment, the transverse length of the agitating member also at least in part defines the size (and at least in part the direction) of the flow path along which the formulation and particulates or other flowable components in the interior space of the chamber flows past the horn. For example, the horn may have a radius of about 0.875 inches (22.2 mm) and the transverse length of each ring is, as discussed above, about 0.5 inches (12.7 mm). The radius of the inner surface of the housing sidewall is approximately 1.75 inches (44.5 mm) so that the transverse spacing between each ring and the inner surface of the housing sidewall is about 0.375 inches (9.5 mm). It is contemplated that the spacing between the horn outer surface and the inner surface of the chamber sidewall and/or between the agitating members and the inner surface of the chamber sidewall may be greater or less than described above without departing from the scope of this disclosure.

In general, the horn 105 may be constructed of a metal having suitable acoustical and mechanical properties. Examples of suitable metals for construction of the horn 105 include, without limitation, aluminum, monel, titanium, stainless steel, and some alloy steels. It is also contemplated that all or part of the horn 105 may be coated with another metal such as silver, platinum, gold, palladium, lead dioxide, and copper to mention a few. In one particularly suitable embodiment, the agitating members 137 are constructed of the same material as the horn 105, and are more suitably formed integrally with the horn. In other embodiments, one or more of the agitating members 137 may instead be formed separate from the horn 105 and connected thereto.

While the agitating members 137 (e.g., the rings) illustrated in FIG. 1 are relatively flat, i.e., relatively rectangular in cross-section, it is understood that the rings may have a cross-section that is other than rectangular without departing from the scope of this disclosure. The term "cross-section" is used in this instance to refer to a cross-section taken along one transverse direction (e.g., radially in the illustrated embodiment) relative to the horn outer surface 107). Additionally, as seen of the first two and last two agitating members 137 (e.g., the rings) illustrated in FIG. 1 are constructed only to have a transverse component, it is contemplated that one or more of the agitating members may have at least one longitudinal (e.g., axial) component to take advantage of transverse vibrational displacement of the horn (e.g., at the third agitating member as illustrated in FIG. 1) during ultrasonic vibration of the waveguide assembly 203.

As best illustrated in FIG. 1, the terminal end 113 of the horn 105 is suitably spaced longitudinally from the inlet end 125 in FIG. 1 to define what is referred to herein as a liquid intake zone in which initial swirling of liquid within the interior space 153 of the chamber housing 151 occurs upstream of the horn 105. This intake zone is particularly useful where the treatment chamber 151 is used for mixing two or more components together (such as with the particulates and the formulation or with two or more components of the formulation from inlet port 156 in FIG. 1) whereby initial mixing is facilitated by the swirling action in the intake zone as the components to be mixed enter the chamber housing 151. It is understood, though, that the terminal end of the horn 105 may be nearer to the inlet end 125 than is illustrated in FIG. 1, and may be substantially adjacent to the inlet port 156 so as to generally omit the intake zone, without departing from the scope of this disclosure.

Additionally, a baffle assembly, generally indicated at 245 is disposed within the interior space 153 of the chamber housing 151, and in particular generally transversely adjacent the inner surface 167 of the sidewall 157 and in generally transversely opposed relationship with the horn 105. In one suitable embodiment, the baffle assembly 245 comprises one or more baffle members 247 disposed adjacent the inner surface 167 of the housing sidewall 157 and extending at least in part transversely inward from the inner surface of the sidewall 167 toward the horn 105. More suitably, the one or more baffle members 247 extend transversely inward from the housing sidewall inner surface 167 to a position longitudinally intersticed with the agitating members 137 that extend outward from the outer surface 107 of the horn 105. The term "longitudinally intersticed" is used herein to mean that a longitudinal line drawn parallel to the longitudinal axis of the horn 105 passes through both the agitating members 137 and the baffle members 247. As one example, in the illustrated embodiment, the baffle assembly 245 comprises four, generally annular baffle members 247 (i.e., extending continuously about the horn 105) longitudinally intersticed with the five agitating members 237.

As a more particular example, the four annular baffle members 247 illustrated in FIG. 1 are of the same thickness as the agitating members 137 in our previous dimensional example (i.e., 0.125 inches (3.2 mm)) and are spaced longitudinally from each other (e.g., between opposed faces of consecutive baffle members) equal to the longitudinal spacing between the rings (i.e., 0.875 inches (22.2 mm)). Each of the annular baffle members 247 has a transverse length (e.g., inward of the inner surface 167 of the housing sidewall 157) of about 0.5 inches (12.7 mm) so that the innermost edges of the baffle members extend transversely inward beyond the outermost edges of the agitating members 137 (e.g., the rings). It is understood, however, that the baffle members 247 need not extend transversely inward beyond the outermost edges of the agitating members 137 of the horn 105 to remain within the scope of this disclosure.

It will be appreciated that the baffle members 247 thus extend into the flow path of the formulation and particulates that flow within the interior space 153 of the chamber 151 past the horn 105 (e.g., within the ultrasonic treatment zone). As such, the baffle members 247 inhibit the formulation and particulates from flowing along the inner surface 167 of the chamber sidewall 157 past the horn 105, and more suitably the baffle members facilitate the flow of the formulation and particulates transversely inward toward the horn for flowing over the agitating members of the horn to thereby facilitate ultrasonic energization (i.e., agitation) of the formulation and particulates to initiate mixing the formulation and particulates within the carrier liquid to form the particulate-containing formulation.

In one embodiment, to inhibit gas bubbles against stagnating or otherwise building up along the inner surface 167 of the sidewall 157 and across the face on the underside of each baffle member 247, e.g., as a result of agitation of the formulation, a series of notches (broadly openings) may be formed in the outer edge of each of the baffle members (not shown) to facilitate the flow of gas (e.g., gas bubbles) between the outer edges of the baffle members and the inner surface of the chamber sidewall. For example, in one particularly preferred embodiment, four such notches are formed in the outer edge of each of the baffle members in equally spaced relationship with each other. It is understood that openings may be formed in the baffle members other than at the outer edges where the baffle members abut the housing, and remain within the scope of this disclosure. It is also understood, that these notches may number more or less than four, as discussed above, and may even be completely omitted.

It is further contemplated that the baffle members 247 need not be annular or otherwise extend continuously about the horn 105. For example, the baffle members 247 may extend discontinuously about the horn 105, such as in the form of spokes, bumps, segments or other discrete structural formations that extend transversely inward from adjacent the inner surface 167 of the housing sidewall 157. The term "continuously" in reference to the baffle members 247 extending continuously about the horn does not exclude a baffle member as being two or more arcuate segments arranged in end-to-end abutting relationship, i.e., as long as no significant gap is formed between such segments. Suitable baffle member configurations are disclosed in U.S. application Ser. No. 11/530,311 (filed Sep. 8, 2006), which is hereby incorporated by reference to the extent it is consistent herewith.

Also, while the baffle members 247 illustrated in FIG. 1 are each generally flat, e.g., having a generally thin rectangular cross-section, it is contemplated that one or more of the baffle members may each be other than generally flat or rectangular in cross-section to further facilitate the flow of bubbles along the interior space 153 of the chamber 151. The term "cross-section" is used in this instance to refer to a cross-section taken along one transverse direction (e.g., radially in the illustrated embodiment, relative to the horn outer surface 107).

Figure 2:
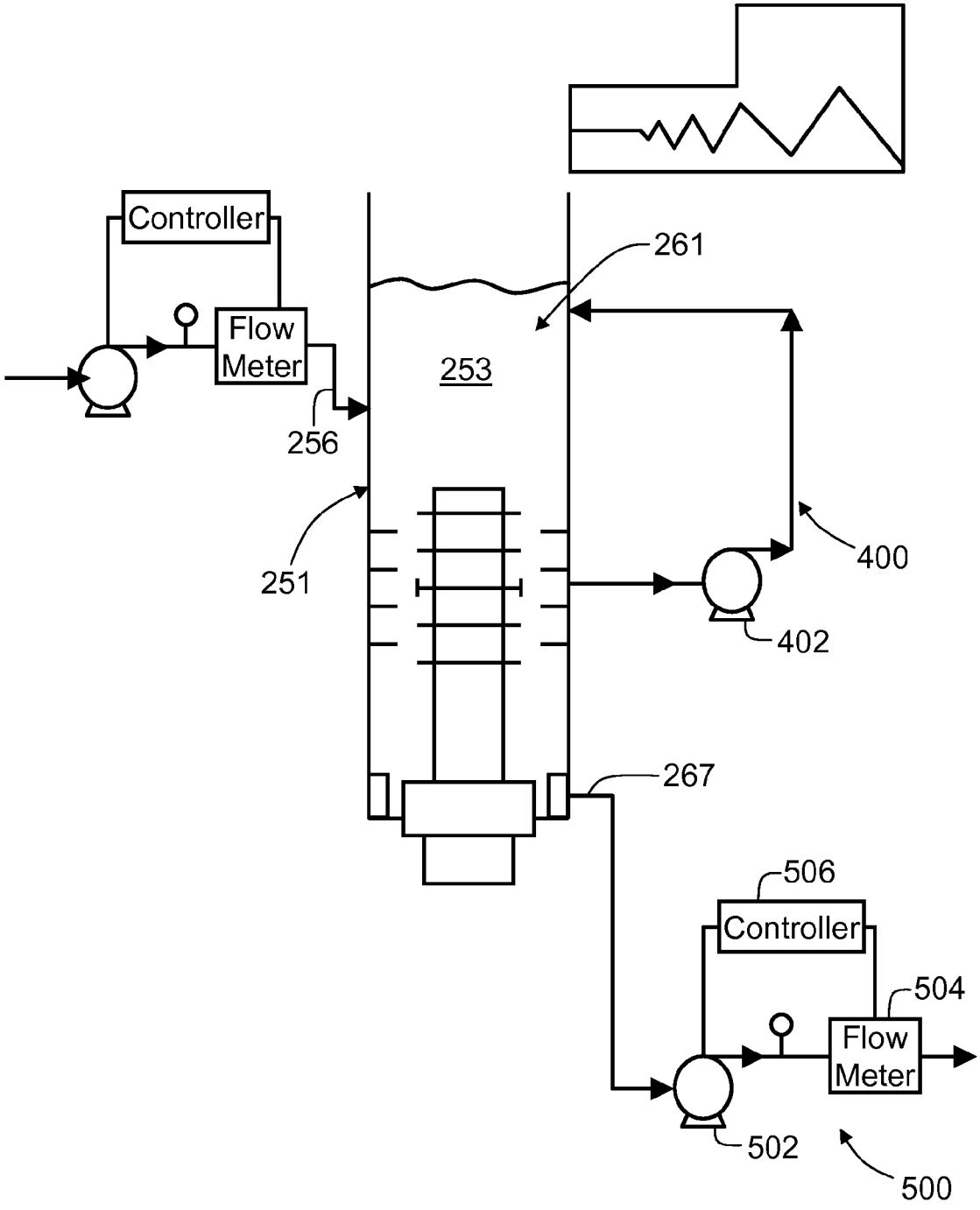
FIG. 2 is a schematic of an ultrasonic mixing system according to a second embodiment of the present disclosure for mixing particulates with a formulation.

In one embodiment, as illustrated in FIG. 2, the treatment chamber may further be in connection with a liquid recycle loop, generally indicated at 400. Typically, the liquid recycle loop 400 is disposed longitudinally between the inlet port 256 and the outlet port 267. The liquid recycle loop 400 recycles a portion of the formulation being mixed with the particulates within the interior space 253 of the housing 251 back into the intake zone (generally indicated at 261) of the interior space 253 of the housing 251. By recycling the formulation back into the intake zone, more effective mixing between the formulation (and its components) and particulates can be achieved as the formulation and particulates are allowed to remain within the treatment chamber, undergoing cavitation, for a longer residence time. Furthermore, the agitation in the upper portion of the chamber (i.e., intake zone) can be enhanced, thereby facilitating better dispersing and/or dissolution of the particulates into the formulation.

The liquid recycle loop can be any system that is capable of recycling the liquid formulation from the interior space of the housing downstream of the intake zone back into the intake zone of the interior space of the housing. In one particularly preferred embodiment, as shown in FIG. 2, the liquid recycle loop 400 includes one or more pumps 402 to deliver the formulation back into the intake zone 261 of the interior space 253 of the housing 251.

Typically, the formulation (and particulates) is delivered back into the treatment chamber at a flow rate having a ratio of recycle flow rate to initial feed flow rate of the formulation (described below) of 1.0 or greater. While a ratio of recycle flow rate to initial feed flow rate is preferably greater than 1.0, it should be understood that ratios of less than 1.0 can be tolerated without departing from the scope of the present disclosure.

In one embodiment, the ultrasonic mixing system may further comprise a filter assembly disposed at the outlet end of the treatment chamber. Many particulates, when initially added to a formulation, can attract one another and can clump together in large balls. Furthermore, many times, particles in the particulate-containing formulations can settle out over time and attract one another to form large balls; referred to as reagglomeration. As such, the filter assembly can filter out the large balls of particulates that form within the particulate-containing formulation prior to the formulation being delivered to a packaging unit for consumer use, as described more fully below. Specifically, the filter assembly is constructed to filter out particulates sized greater than about 0.2 microns.

Specifically, in one particularly preferred embodiment, the filter assembly covers the inner surface of the outlet port. The filter assembly includes a filter having a pore size of from about 0.5 micron to about 20 microns. More suitably, the filter assembly includes a filter having a pore size of from about 1 micron to about 5 microns, and even more suitably, about 2 microns. The number and pour size of filters for use in the filter assembly will typically depend on the particulates and formulation to be mixed within the treatment chamber.

In operation according to one embodiment of the ultrasonic mixing system of the present disclosure, the mixing system (more specifically, the treatment chamber) is used to mix/disperse particulates into one or more formulations. Specifically, a formulation is delivered (e.g., by the pumps described above) via conduits to one or more inlet ports formed in the treatment chamber housing. The formulation can be any suitable formulation known in the art. For example, suitable formulations can include hydrophilic formulations, hydrophobic formulations, siliphilic formulations, and combinations thereof. Examples of particularly suitable formulations to be mixed within the ultrasonic mixing system of the present disclosure can include emulsions such as oil-in-water emulsions, water-in-oil emulsions, water-in-oil-in-water emulsions, oil-in-water-in-oil emulsions, water-in-silicone emulsions, water-in-silicone-in-water emulsions, glycol-in-silicone emulsion, high internal phase emulsions, hydrogels, and the like. High internal phase emulsions are well known in the art and typically refer to emulsions having from about 70% (by total weight emulsion) to about 80% (by total weight emulsion) of an oil phase. Furthermore, as known by one skilled in the art, "hydrogel" typically refers to a hydrophilic base that is thickened with rheology modifiers and or thickeners to form a gel. For example a hydrogel can be formed with a base consisting of water that is thickened with a carbomer that has been neutralized with a base.

Generally, from about 0.1 liters per minute to about 100 liters per minute of the formulation is typically delivered into the treatment chamber housing. More suitably, the amount of formulation delivered into the treatment chamber housing is from about 1.0 liters per minute to about 10 liters per minute.

In one embodiment, the formulation is prepared using the ultrasonic mixing system simultaneously during delivery of the formulation into the interior space of the housing and mixing with the particulates. In such an embodiment, the treatment chamber can include more than one inlet port to deliver the separate components of the formulation into the interior space of the housing. For example, in one embodiment, a first component of the formulation can be delivered via a first inlet port into the interior space of the treatment chamber housing and a second component of the formulation can be delivered via a second inlet port into the interior space of the treatment chamber housing. In one embodiment, the first component is water and the second component is zinc oxide. The first component is delivered via the first inlet port to the interior space of the housing at a flow rate of from about 0.1 liters per minute to about 100 liters per minute, and the second component is delivered via the second inlet port to the interior space of the housing at a flow rate of from about 1 milliliter per minute to about 1000 milliliters per minute.

Typically, the first and second inlet ports are disposed in parallel along the sidewall of the treatment chamber housing. In an alternative embodiment, the first and second inlet ports are disposed on opposing sidewalls of the treatment chamber housing. While described herein as having two inlet ports, it should be understood by one skilled in the art that more than two inlet ports can be used to deliver the various components of the formulations without departing from the scope of the present disclosure.

In one embodiment, the formulation (or one or more of its components) is heated prior to being delivered to the treatment chamber. With some formulations, while the individual components have a relatively low viscosity (i.e., a viscosity below 100 cps), the resulting formulation made with the components has a high viscosity (i.e., a viscosity greater than 100 cps), which can result in clumping of the formulation and clogging of the inlet port of the treatment chamber. For example, many water-in-oil emulsions can suffer from clumping during mixing. In these types of formulations, the water and/or oil components are heated to a temperature of approximately 40° C. or higher. Suitably, the formulation (or one or more of its components) can be heated to a temperature of from about 70° C. to about 100° C. prior to being delivered to the treatment chamber via the inlet port.

Additionally, the method includes delivering particulates, such as those described above, to the interior space of the chamber to be mixed with the formulation. Specifically, the particulates are delivered to an intake zone within the interior space of the housing. Specifically, in one embodiment, the horn within the interior space of the housing has a terminal end substantially spaced longitudinally from the inlet port, as described more fully herein, to define an intake zone. The particulates to be mixed with the formulation are delivered into the intake zone of the treatment chamber housing.

Typically, as described more fully above, the particulates are delivered using the particulate dispensing system described above. Specifically, the particulate dispensing system is suitably disposed above the intake zone of the treatment chamber. Once delivered from the particulate dispensing system, the particulates will descend downward and begin mixing with the formulation being delivered via the inlet port into the interior space of the housing.

Typically, the particulate dispensing system is capable of metering the delivery of the particulates using an agar. With such a mechanism, the particulates are delivered into the interior space at a rate of from about 1 gram per minute to about 1000 grams per minute. More suitably, the particulates are delivered into the interior space at a rate of from about 5 grams per minute to about 500 grams per minute.

In accordance with the above embodiment, as the formulation and particulates continue to flow downward within the chamber, the waveguide assembly, and more particularly the horn assembly, is driven by the drive system to vibrate at a predetermined ultrasonic frequency. In response to ultrasonic excitation of the horn, the agitating members that extend outward from the outer surface of the horn dynamically flex/bend relative to the horn, or displace transversely (depending on the longitudinal position of the agitating member relative to the nodal region of the horn).

The formulation and particulates continuously flow longitudinally along the flow path between the horn assembly and the inner surface of the housing sidewall so that the ultrasonic vibration and the dynamic motion of the agitating members causes cavitation in the formulation to further facilitate agitation. The baffle members disrupt the longitudinal flow of formulation along the inner surface of the housing sidewall and repeatedly direct the flow transversely inward to flow over the vibrating agitating members.

As the mixed particulate-containing formulation flows longitudinally downstream past the terminal end of the waveguide assembly, an initial back mixing of the particulate-containing formulation also occurs as a result of the dynamic motion of the agitating member at or adjacent the terminal end of the horn. Further downstream flow of the particulate-containing formulation results in the agitated formulation providing a more uniform mixture of components (e.g., components of formulation and particulates) prior to exiting the treatment chamber via the outlet port.

In one embodiment, as illustrated in FIG. 2, as the particulate-containing formulation travels downward, a portion of the particulate-containing formulation is directed out of the housing prematurely through the liquid recycle loop as described above. This portion of particulate-containing formulation is then delivered back into the intake zone of the interior space of the housing of the treatment chamber to be mixed with fresh formulation and particulates. By recycling a portion of the particulate-containing formulation, a more thorough mixing of the formulation and particulates occurs.

Once the particulate-containing formulation is thoroughly mixed, the particulate-containing formulation exits the treatment chamber via the outlet port. In one embodiment, once exited, the particulate-containing formulation can be directed to a post-processing delivery system to be delivered to one or more packaging units. Without being limiting, for example, the particulate-containing formulation is a cosmetic formulation containing mica particulates to provide improved skin feel and the particulate-containing formulation can be directed to a post-processing delivery system to be delivered to a lotion-pump dispenser for use by the consumer.

The post-processing delivery system can be any system known in the art for delivering the particulate-containing formulation to end-product packaging units. For example, in one particularly preferred embodiment, as shown in FIG. 2, the post-processing delivery system, generally indicated at 500, includes a pump 502 to deliver the particulate-containing formulation to one or more packaging units (not shown). The post-processing delivery system 500 may further include one or both of a flow meter 504 and controller 506 to control the rate at which the particulate-containing formulation can be delivered to the packaging unit. Any flow meter and/or controller known in the art and suitable for dispensing a liquid formulation can be used to deliver the particulate-containing formulation to one or more packaging units without departing from the scope of the present disclosure.

The present disclosure is illustrated by the following example which is merely for the purpose of illustration and is not to be regarded as limiting the scope of the disclosure or manner in which it may be practiced.

EXAMPLE 1

In this Example, various particulates were mixed with tap water in the ultrasonic mixing system of FIG. 1 of the present disclosure. The ability of the ultrasonic mixing system to effectively mix the particulates into the water formulation to form a homogenous mixture was compared to manually stirring the mixture in a beaker. Additionally, the ability of the particulates to remain homogenously mixed with the water was analyzed and compared to the mixture produced using manual stirring in the beaker.

Each particulate-type was independently added to tap water and mixed using either the ultrasonic mixing system of FIG. 1 or a spatula manually stirring the liquid in a beaker. All samples of particulate-containing water were visually observed immediately after mixing, 10 minutes after mixing, 1 hour after mixing, 20 hours after mixing, and 30 hours after mixing. The various particulates, amounts of particulates, amount of tap water, and visual observations are shown in Table 3.

TABLE 3

| | | | | Visual Observation | | | | |
|---|---|---|---|---|---|---|---|---|
| Sample | Weight (%) | Mixing Method | Mixing Time (min.) | Immediately after mixing | 10 min. after mixing | 1 hour after mixing | 20 hr. after mixing | 30 hr. after mixing |
| | | | | A | | | | |
| Hydroxyethylcellulose (NATROSOL ®, Hercules, Inc., Wilmington, Delaware) | 0.28 | Ultra-sonic Mixing | 1 | Fish-eye clusters were gone; completely clear formulation | Stable; clear formulation | Stable; clear formulation | Stable; clear formulation | Stable; clear formulation |
| Water | 99.72 | | | | | | | |
| | | | | B | | | | |
| Hydroxyethylcellulose (NATROSOL ®, Hercules, Inc., Wilmington, Delaware) | 2.44 | Hand Mixing | 2 | Fish-eye clusters present | Fish-eye clusters still present | Fish-eye clusters still present | Fish-eye clusters were gone | Stable; clear formulation |
| Water | 97.56 | | | | | | | |
| | | | | C | | | | |
| Zinc oxide (GLENN-20, USP-1, GLENN Co., St. Paul, Minnesota) | 0.42 | Ultra-sonic Mixing | 2 | Milk-like formulation | Milk-like formulation | Gradual settling of zinc oxide | Small particulates setting on bottom of container | Zinc oxide particulates completely separated from water |
| Water | 99.56 | | | | | | | |
| | | | | D | | | | |
| Zinc oxide (GLEN-20, USP-1, GLENN Co., St. Paul, Minnesota) | 2.44 | Hand Mixing | 2 | Milk-like formulation only during stirring | Coarse particulates completely settled on bottom of container | Zinc oxide particulculates completely separated from water | | |
| Water | 97.56 | | | | | | | |

TABLE 3-continued

| Sample | Weight (%) | Mixing Method | Mixing Time (min.) | Visual Observation: Immediately after mixing | 10 min. after mixing | 1 hour after mixing | 20 hr. after mixing | 30 hr. after mixing |
|---|---|---|---|---|---|---|---|---|
| | | | | E | | | | |
| Sodium polyacylate (COSMEDIA SP, Cognis Co., Cincinnati, Ohio) | 0.38 | Ultra-sonic mixing | 4 | Hard to dissolve in water, however, after 4 minutes became a clear solution | Stable; clear solution | Stable; clear solution | High viscosity gel-like formulation | High viscosity gel-like formulation |
| Water | 99.62 | | | | | | | |
| | | | | F | | | | |
| Sodium polyacylate (COSMEDIA SP, Cognis Co., Cincinnati, Ohio) | 2.44 | Hand mixing | 4 | Hard to dissolve in water; large clumps present | Large clumps still present | Large clumps still present | Large clumps still present | Large clumps still present |
| Water | 97.56 | | | | | | | |

As can be seen in Table 3, ultrasonic mixing with the ultrasonic mixing system of the present disclosure allowed for faster, and more efficient mixing. Specifically, the particulate-containing water formulations were completely homogenous after a shorter period of time; that is the particulates completely dissolved faster in the water using the ultrasonic mixing system of the present disclosure as compared to hand mixing. Furthermore, the ultrasonic mixing system produced particulate-containing formulations that remained stable, homogenous formulations for a longer period of time.

When introducing elements of the present disclosure or preferred embodiments thereof, the articles "a", "an", "the", and "said" are intended to mean that there are one or more of the elements. The terms "comprising", "including", and "having" are intended to be inclusive and mean that there may be additional elements other than the listed elements.

As various changes could be made in the above constructions and methods without departing from the scope of the invention, it is intended that all matter contained in the above description and shown in the accompanying drawings shall be interpreted as illustrative and not in a limiting sense.

What is claimed is:

1. An ultrasonic mixing system for mixing particulates into a formulation, the mixing system comprising:

a particulate dispensing system capable of dispensing particulates into a treatment chamber for mixing with a formulation; and the treatment chamber comprising:

an elongate housing having longitudinally opposite ends and an interior space, the housing being generally closed at at least one longitudinal end and having at least one inlet port for receiving the formulation into the interior space of the housing and at least one outlet port through which a particulate-containing formulation is exhausted from the housing following ultrasonic mixing of the formulation and particulates to form the particulate-containing formulation, the outlet port being spaced longitudinally from the inlet port such that the formulation and particulates flow longitudinally within the interior space of the housing from the inlet port to the outlet port; and an elongate ultrasonic waveguide assembly extending longitudinally within the interior space of the housing and being operable at a predetermined ultrasonic frequency to ultrasonically energize and mix the formulation and particulates flowing within the housing, the waveguide assembly comprising an elongate ultrasonic horn disposed at least in part intermediate the inlet port and the outlet port of the housing and having an outer surface located for contact with the formulation and particulates flowing within the housing from the inlet port to the outlet port, and a plurality of discrete agitating members in contact with and extending transversely outward from the outer surface of the horn intermediate the inlet port and the outlet port in longitudinally spaced relationship with each other, the agitating members and the horn being constructed and arranged for dynamic motion of the agitating members relative to the horn upon ultrasonic vibration of the horn at the predetermined frequency and to operate in an ultrasonic cavitation mode of the agitating members corresponding to the predetermined frequency and the formulation and particulates being mixed in the chamber, wherein at least one of the agitating members has a ratio of transverse length to thickness of the agitating member in the range of about 2:1 to about 6:1.

2. The ultrasonic mixing system as set forth in claim 1 wherein the particulates are selected from the group consisting of rheology modifiers, sensory enhancers, pigments, lakes, dyes, abrasives, absorbents, anti-caking, anti-acne, anti-dandruff, anti-perspirant, binders, bulking agents, colorants, deodorants, exfoliants, opacifying agents, oral care agents, skin protectants, slip modifiers, suspending agents, warming agents and combinations thereof.

3. The ultrasonic mixing system as set forth in claim 1 further comprising a delivery system operable to deliver the formulation to the interior space of the housing of the treatment chamber through the inlet port, wherein the formulation is delivered to the inlet port at a rate of from about 0.1 liters per minute to about 100 liters per minute.

4. The ultrasonic mixing system as set forth in claim 1 wherein the formulation is selected from the group consisting of hydrophilic formulations, hydrophobic formulations, siliphilic formulations, and combinations thereof.

5. The ultrasonic mixing system as set forth in claim 1 wherein the predetermined frequency is in a range of from about 20 kHz to about 40 kHz.

6. The ultrasonic mixing system as set forth in claim 1 wherein the inlet port is a first inlet port, the treatment chamber further comprising a second inlet port oriented in parallel, spaced relationship with the first inlet port.

7. The ultrasonic mixing system as set forth in claim 1 wherein the horn has a terminal end within the interior space of the housing and substantially spaced longitudinally from the inlet port to define an intake zone therebetween within the interior space of the housing.

8. The ultrasonic mixing system as set forth in claim 7 further comprising a liquid recycling system disposed longitudinally between the inlet port and the outlet port and being capable of recycling a portion of the formulation being mixed with the particulates within the housing back into the intake zone of the interior space of the housing.

9. An ultrasonic mixing system for mixing particulates into a formulation, the mixing system comprising:

a particulate dispensing system capable of dispensing particulates into a treatment chamber for mixing with a formulation; and the treatment chamber comprising:

an elongate housing having longitudinally opposite ends and an interior space, the housing being generally closed at at least one longitudinal end and having at least one inlet port for receiving the formulation into the interior space of the housing and at least one outlet port through which a particulate-containing formulation is exhausted from the housing following ultrasonic mixing of the formulation and particulates to form the particulate-containing formulation, the outlet port being spaced longitudinally from the inlet port such that the formulation and particulates flow longitudinally within the interior space of the housing from the inlet port to the outlet port;

an elongate ultrasonic waveguide assembly extending longitudinally within the interior space of the housing and being operable at a predetermined ultrasonic frequency to ultrasonically energize and mix the formulation and particulates flowing within the housing, the waveguide assembly comprising an elongate ultrasonic horn disposed at least in part intermediate the inlet port and the outlet port of the housing and having an outer surface located for contact with the formulation and particulates flowing within the housing from the inlet port to the outlet port, a plurality of discrete agitating members in contact with and extending transversely outward from the outer surface of the horn intermediate the inlet port and the outlet port in longitudinally spaced relationship with each other, the agitating members and the horn being constructed and arranged for dynamic motion of the agitating members relative to the horn upon ultrasonic vibration of the horn at the predetermined frequency and to operate in an ultrasonic cavitation mode of the agitating members corresponding to the predetermined frequency and the formulation and particulates being mixed in the chamber, and a baffle assembly disposed within the interior space of the housing and extending at least in part transversely inward from the housing toward the horn to direct longitudinally flowing formulation and particulates in the housing to flow transversely inward into contact with the agitating members, wherein the baffle assembly comprises annular baffle members extending continuously about the horn.

10. The ultrasonic mixing system as set forth in claim 9 wherein the particulates are selected from the group consisting of rheology modifiers, sensory enhancers, pigments, lakes, dyes, abrasives, absorbents, anti-caking, anti-acne, anti-dandruff, anti-perspirant, binders, bulking agents, colorants, deodorants, exfoliants, opacifying agents, oral care agents, skin protectants, slip modifiers, suspending agents, warming agents and combinations thereof.

11. The ultrasonic mixing system as set forth in claim 9 further comprising a delivery system operable to deliver the formulation to the interior space of the housing of the treatment chamber through the inlet port, wherein the formulation is delivered to the inlet port at a rate of from about 0.1 liters per minute to about 100 liters per minute.

12. The ultrasonic mixing system as set forth in claim 9 wherein the formulation is selected from the group consisting of hydrophilic formulations, hydrophobic formulations, siliphilic formulations, and combinations thereof.

13. The ultrasonic mixing system as set forth in claim 9 wherein the predetermined frequency is in a range of from about 20 kHz to about 40 kHz.

14. The ultrasonic mixing system as set forth in claim 9 wherein the inlet port is a first inlet port, the treatment chamber further comprising a second inlet port oriented in parallel, spaced relationship with the first inlet port.

15. The ultrasonic mixing system as set forth in claim 9 wherein the horn has a terminal end within the interior space of the housing and substantially spaced longitudinally from the inlet port to define an intake zone therebetween within the interior space of the housing.

16. The ultrasonic mixing system as set forth in claim 15 further comprising a liquid recycling system disposed longitudinally between the inlet port and the outlet port and being capable of recycling a portion of the formulation being mixed with the particulates within the housing back into the intake zone of the interior space of the housing.

17. A method for mixing particulates into a formulation using the ultrasonic mixing system of claim 1, the method comprising:

delivering particulates to an intake zone within the interior space of the housing, the intake zone being defined as a space between a terminal end of the horn within the interior space of the housing and the inlet port;

delivering the formulation via the inlet port into the interior space of the housing; and ultrasonically mixing the particulates and formulation via the elongate ultrasonic waveguide assembly operating in the predetermined ultrasonic frequency.

18. The method as set forth in claim 17 wherein the particulates are selected from the group consisting of rheology modifiers, sensory enhancers, pigments, lakes, dyes, abrasives, absorbents, anti-caking, anti-acne, anti-dandruff, anti-perspirant, binders, bulking agents, colorants, deodorants, exfoliants, opacifying agents, oral care agents, skin protectants, slip modifiers, suspending agents, warming agents and combinations thereof.

19. The method as set forth in claim 17 wherein the formulation is selected from the group consisting of hydrophilic formulations, hydrophobic formulations, siliphilic formulations, and combinations thereof.

20. The method as set forth in claim 17 wherein the formulation is delivered to the interior space of the housing at a flow rate of from about 0.1 liters per minute to about 100 liters per minute.

21. The method as set forth in claim 19 wherein the inlet port is a first inlet port, the treatment chamber further comprising a second inlet port oriented in parallel spaced relationship with the first inlet port.

22. The method as set forth in claim 21 wherein the formulation is prepared simultaneously during delivery of the formulation to the interior space of the housing and wherein at least a first component of the formulation is delivered via the first inlet port and at least a second component of the formulation is delivered via the second port.

23. The method as set forth in claim 17 wherein the formulation is heated prior to being delivered to the interior space of the housing.

24. The method as set forth in claim 17 wherein the particulates and formulation are ultrasonically mixed using the predetermined frequency being in a range of from about 20 kHz to about 40 kHz.

25. The method as set forth in claim 17 further comprising recycling a portion of the formulation to be mixed with the particulates via a liquid recycling system.

* * * * *